US007004554B2

(12) United States Patent
Takekoshi et al.

(10) Patent No.: US 7,004,554 B2
(45) Date of Patent: Feb. 28, 2006

(54) INK JET PRINTING APPARATUS

(75) Inventors: Nobuhiko Takekoshi, Kanagawa (JP); Takeshi Irizawa, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 10/414,227

(22) Filed: Apr. 16, 2003

(65) Prior Publication Data

US 2003/0234847 A1 Dec. 25, 2003

(30) Foreign Application Priority Data

Apr. 18, 2002 (JP) ..... 2002-116872

(51) Int. Cl.
*B41J 3/00* (2006.01)

(52) U.S. Cl. ..... 347/2; 347/102; 347/105

(58) Field of Classification Search ..... 347/102, 347/196, 105, 106, 2, 104, 1
See application file for complete search history.

(56) References Cited

U.S. PATENT DOCUMENTS

| | | | | |
|---|---|---|---|---|
| 5,255,011 A | * | 10/1993 | Minowa et al. | 347/196 |
| 5,346,318 A | | 9/1994 | Endo | 400/120.15 |
| 5,502,464 A | | 3/1996 | Takahashi et al. | 346/25 |
| 6,120,199 A | | 9/2000 | Takekoshi | 400/611 |
| 2002/0027586 A1 | * | 3/2002 | Kikuchi et al. | 347/104 |
| 2003/0019424 A1 | | 1/2003 | Takekoshi et al. | 118/258 |
| 2003/0024474 A1 | | 2/2003 | Suzuki et al. | 118/258 |

FOREIGN PATENT DOCUMENTS

| | | |
|---|---|---|
| JP | 62-161583 | 7/1987 |
| JP | 2570715 | 10/1996 |
| JP | 2761671 | 3/1998 |
| JP | 2879784 | 1/1999 |
| JP | 3088520 | 7/2000 |
| JP | 2001-232782 | 8/2001 |

* cited by examiner

*Primary Examiner*—Hai Pham
*Assistant Examiner*—Lam S Nguyen
(74) *Attorney, Agent, or Firm*—Fitzpatrick, Cella, Harper & Scinto

(57) ABSTRACT

The present invention performs a uniform lamination on a print medium by controlling generated heat of the thermal head for forming a protective layer according to a volume of water contained in the print medium. For this purpose, the apparatus has a printing unit to form an image on a print medium according to an input image signal by using an ink jet print head having a plurality of nozzles for ejecting ink droplets and a post-processing unit to form a protective layer on the print medium printed with the image in the printing unit by applying heat energy generated by a thermal head to a protective material. The heat energy applied from the thermal head to the printed medium is controlled by a control unit according to a printing condition, such as an ink volume applied to the print medium.

25 Claims, 25 Drawing Sheets

34 PIXELS/144 PIXELS, TOTAL DENSITY = ABOUT 94%, AVERAGE DENSITY = 24%

| TOTAL DENSITY | A | B | C | D | E | F |
|---|---|---|---|---|---|---|
| 0 | 1 | 1 | 1 | 1 | 1 | 1 |
| 1 | 1 | 1 | 1 | 1 | 1 | 1 |
| 2 | 1 | 1 | 0 | 0 | 0 | 1 |
| 3 | 1 | 1 | 0 | 2 | 0 | 1 |
| 4 | 1 | 1 | 0 | 0 | 0 | 1 |
| 5 | 2 | 1 | 2 | 2 | 2 | 2 |

| IMAGE | DRIVE WAVEFORM % |
|---|---|
| 0 | 82 |
| 1 | 91 |
| 2 | 100 |

WATER VOLUME NO. TABLE

| APPLICATION VOLUME RANK | ELAPSED TIME (s) | | | |
|---|---|---|---|---|
| | ~10 | 11~10 | 21~30 | 31~ |
| A | 2 | 1 | 1 | 1 |
| B | 4 | 3 | 2 | 2 |
| C | 6 | 5 | 4 | 3 |

FIG.11

Pop NO. TABLE

| THERMAL HEAD TEMPERATURE (℃) | WATER VOLUME NO. | | | | | |
|---|---|---|---|---|---|---|
| | 1 | 2 | 3 | 4 | 5 | 6 |
| ~35 | 4 | 5 | 6 | 7 | 8 | 8 |
| 36~40 | 3 | 4 | 5 | 6 | 7 | 7 |
| 41~45 | 2 | 3 | 4 | 5 | 6 | 6 |
| 46~50 | 1 | 2 | 3 | 4 | 5 | 5 |

FIG.12

Pop NO. VS.
DRIVE VOLTAGE APPLICATION TIME TABLE

| PopNo. | DRIVE VOLTAGE APPLICATION TIME |
|---|---|
| 1 | 0.5 |
| 2 | 0.6 |
| 3 | 0.7 |
| 4 | 0.8 |
| 5 | 0.9 |
| 6 | 1.0 |
| 7 | 1.1 |
| 8 | 1.2 |

UNIT: ms

FIG.13

WATER VOLUME NO. TABLE

| APPLICATION VOLUME RANK | AREA | | | |
|---|---|---|---|---|
| | AREA-1 | AREA-2 | AREA-3 | AREA-4 |
| A | 2 | 1 | 1 | 1 |
| B | 4 | 3 | 2 | 2 |
| C | 6 | 5 | 4 | 3 |

FIG.21

WATER VOLUME NO. TABLE

| APPLICATION VOLUME RANK | HEAT TRANSFER DRIVE PULSE NUMBER | | | |
|---|---|---|---|---|
| | 768 | 1536 | 2304 | 3072 |
| A | 2 | 1 | 1 | 1 |
| B | 4 | 3 | 2 | 2 |
| C | 6 | 5 | 4 | 3 |

FIG.23

INK JET PRINTING APPARATUS

This application claims priority from Japanese Patent Application No. 2002-116872 filed Apr. 18, 2002, which is incorporated hereinto by reference.

BACKGROUND OF THE INVENTION

1. Field of the Invention

The present invention relates to an ink jet printing apparatus that forms an image by ejecting ink from a print head onto a print medium, and more particularly to an ink jet printing apparatus with a post-processing unit which, after a printing operation, forms a protective layer over a printed medium by performing a lamination on the surface of the printed medium using a thermal head. This ink jet printing apparatus can function in a printer, copying machine or facsimile machine, or as an output device for a combination machine such as a computer or word processor or as an output device for a workstation.

2. Description of the Related Art

A variety of kinds of printing apparatus has been used for an input device which, according to print information, outputs various images (including characters and symbols) to different kinds of print media (printing materials). The printing apparatus may be categorized according to a printing method employed by a printing means used, such as an ink jet printing apparatus, a wire dot printing apparatus, a thermal printing apparatus, a sublimation transfer printing apparatus, an electrophotographic printing apparatus and a silver salt photographic printing apparatus.

Of these, the ink jet printing apparatus ejects ink droplets (including droplets of printing performance improving liquid) from nozzles of a print head. Because of its ability to perform printing without bringing the print head into contact with a print medium, this ink jet printing apparatus is quiet during the printing operation and can print a high resolution image at high speed on a variety of print media, from plain paper to rough print media, without requiring any special processing. It also has advantages of an ease with which it can print color images using multiple color inks, a low manufacturing cost and a low running cost.

Particularly in the case of a printing means (print head) of a so-called Bubble Jet (trademark) type, in which a bubble is generated in ink by thermal energy produced by an electrothermal transducer to eject an ink droplet by a pressure of the bubble as it grows, a high-density liquid path arrangement (nozzle arrangement) can be realized by performing a semiconductor device manufacturing process, including etching, deposition and sputtering, to form the electrothermal transducers, electrodes, liquid path walls and ceilings on a substrate. Therefore, the print head of this printing method can be constructed compactly.

The ink jet printing apparatus can be classified largely into a serial type and a full line type. The serial type ink jet printing apparatus prints an image (including characters and symbols) on a print medium set at a predetermined printing position by reciprocally moving the printing means (print head) along with a carriage in a main scan direction. After the print head has printed one line of data, the print medium is fed a predetermined distance in a subscan direction. By repeating the printing action and the print medium feeding action, an image is printed on the print medium in a desired range.

In the full line type ink jet printing apparatus, the printing means is secured at a fixed position and performs printing by feeding the print medium in the subscan direction to form an image on the entire area of the print medium.

The present invention can be applied to either of these types. In the following explanation, a serial type ink jet printing apparatus, which is most popular as a general purpose ink jet printing apparatus, will be taken as an example.

FIG. 24 is a perspective view schematically showing a construction of a printing unit 20 of a serial type ink jet printing apparatus in wide use.

In FIG. 24, designated by reference numeral 1 is a printing means having a plurality of print heads that eject ink droplets onto a print medium for forming an image. Here, four kinds of print heads 1Y, 1C, 1M, 1Bk are provided that eject four colors of ink, yellow, cyan, magenta and black. Denoted by reference numeral 2 is an ink supply unit 19 that supply inks to the associated print heads. There are four ink tanks storing the four colors of ink, yellow, cyan, magenta and black.

A transport roller 23 is driven by a paper feed motor (not shown) to move a print medium 23*a* in the form of continuous paper or a cut sheet. The transport roller 23 rotates with high precision to determine the distance that the print medium 23*a* is moved.

Print media used for ink jet printing are made from a material capable of absorbing a liquid ink well and having a characteristic such that it can easily absorb water and other substances even after an image has been formed. Suppose a water-absorbing print medium already formed with an image is to be printed further. Printing on such a print medium with an ink containing a water-soluble ink or alcohol solvent may cause the already formed image to bleed, which is undesirable. Further, if an inert gas coming out of a resin of transparent file, such as vinyl chloride and polypropylene, or tobacco smoke is present around printed media, the media may absorb contaminating substances resulting in the fading of the printed image.

As described above, a print medium formed with an image by ink jet printing has drawbacks of low water resistance, low weather resistance and, therefore, low permanence of the printed image. Other drawbacks reside in that an irregularity appears on an outer surface of a printing medium when a material having a good ink absorbing characteristic is applied to the printing medium in such a manner constituting a porous structure (more than the structure of an ink coloring material) in order for a better ink absorbing characteristic, and that an irregularity of a surface of a base material appears on the outer surface of the printing medium when using the base material having a good ink absorbing characteristic, respectively, resulting in degradation of a texture of the printing medium, e.g., the printing medium after printing may lack a glossy surface. When, on the other hand, the print medium used is made of a glossy film as a base material, a relatively glossy print can be obtained, but another problem arises in that because applied ink droplets must be absorbed only by a coating at a top layer, the ink absorbing performance is degraded. To deal with this problem, it has conventionally been proposed that after an image is printed, post-processing be performed, which involves laminating the surface of the printed medium with a transparent or translucent film or sheet-like member, or applying an oil or wax agent to the medium surface.

However, in the post-processing that applies a post-processing liquid such as an oil or wax agent to the printed medium after printing, there is a difference in a post-processing liquid absorbing capacity between an area that has already absorbed ink and an area that has not yet absorbed it, resulting in causing non-uniformity of the post-processing liquid between the areas. To cope with this problem it has been proposed that the printed medium be dried by a drying means before performing the post-processing so that the post-processing liquid can be applied uniformly over an entire area including those locations where the ink has been absorbed. This method, however, requires a drying process to fix the applied post-processing liquid on the print medium, making the apparatus large in size.

On the other hand, a printing apparatus that performs a lamination on the surface of the printed medium as by a heat transfer method can be constructed relatively compact and is recognized for its ability to enhance weatherability and water resistance.

Examples of apparatus that perform laminations on the surfaces of printed media include Japanese Patent Application Laid-open Nos. 62-161583 (1987) and 2001-232782. Here, let us turn to FIG. 25 to explain about a printing apparatus that has a post-processing unit for performing lamination.

A printing apparatus shown in FIG. 25 has an ink jet printing unit 20 similar in construction to that shown in FIG. 24. This printing apparatus, like the one shown in FIG. 24, performs the printing operation by main-scanning the print head 1 in the direction of arrows Sa, Sb, while at the same time feeding the print medium 23*a* intermittently in the direction of arrow Sy.

In coordination with the scanning of the print head 1, the print medium 23*a* is fed a predetermined distance with a high precision by a pair of transport rollers 23. The print head 1 ejects ink from its nozzles by using, for example, thermal energy.

In FIG. 25, the print medium 23*a* is schematically shown to be continuous, from a pre-printing feeding unit up to a post-processing unit 70. In reality, however, the print medium has a maximum recording length so set that, when the printing is finished, the maximum recording length lies a predetermined distance in front of the post-processing unit in the feeding direction.

Until the printing operation is completed, the print medium is fed a predetermined distance as the printing action of the print head proceeds. Then, during the post-processing operation by the post-processing unit 70, the print medium is transported continuously at a constant speed. In a process of switching between the two different transport actions, the above-described predetermined distance plays a role as a buffer area. After having been printed with an image, the print medium 23*a* is led by paired rollers into the post-processing unit 70.

The post-processing unit 70 has a full line type thermal head 300 employing a known heat transfer method, a platen roller 210 opposing the thermal head, a supply roller 81A having a transfer film F wound on it, and a takeup roller 81B for winding up the transfer film F fed from the supply roller 81A. The transfer film F extending from the supply roller 81A to the takeup roller 81B engages the thermal head 300 and is transported with an even, constant tension.

In the post-processing unit 70 of the above construction, when the print medium 23*a* is supplied into the post-processing unit, the thermal head 300 applies heat to the print medium 23*a* over an image-printed width or a width of the print medium. As a result, transparent resin or wax or both are transferred from the transfer film F onto the printing surface of the print medium 23*a* to form a transparent protective layer. At this time, a base material of the transfer film carrying the protective layer (the base material is made of, for example, polyethylene tereprithalate or PET) is wound up on the takeup roller 81B for disposal after use.

In this printing apparatus, in which the transparent protective layer is heated and transferred onto the print medium in the post-processing unit, there is a problem that an optimum amount of heat applied for film transfer varies depending on the amount of water absorbed in the surface of the print medium. That is, in areas that have absorbed a large volume of water in the top layer of the print medium, the heat capacity of water is large. This means that when these areas are heated, the water evaporates to dissipate heat, preventing the temperature at these areas from rising sufficiently. Conversely, in areas with a small volume of water, the heat capacity of water is small, so that upon heating the temperature rises too much. Therefore, the film transferability greatly varies according to the amount of water contained in the print medium, making it impossible to secure a uniform and stable transferability. Such a tendency becomes more conspicuous as an average volume of ink increases, as when using dark and light inks, and also as the printing speed increases.

The amount of water absorbed in the print medium is greatly affected by the amount of ink ejected onto the print medium during the ink jet printing process, by an environment surrounding the print medium (temperature and humidity), and by a time it takes from when the ink has landed on the print medium until a lamination starts (affecting the amount of water in the print medium that evaporates). Hence, with an ink jet printing apparatus with a conventional lamination unit, it is extremely difficult to form a uniform protective layer on the print medium stably.

In a printing apparatus that prints image data by using a print head of a thermal transfer printing methods, a construction for controlling a drive pulse according to image data, a drive history of heat transfer printing input pulses or old print data is described in, for example, Japanese Patent Nos. 2570715, 2879784 and 3088520. This conventional printing apparatus, however, simply uses a heat transfer print head for printing image data, rather than using it for laminating print media. That is, the heat transfer print head used in the conventional printing apparatus is not intended to make the print medium lamination uniform.

A method of controlling, according to print data, a condition of fixing a printed image formed by ink jet printing is proposed in Japanese Patent No. 2761671. A construction described in this patent, however, is not intended for lamination, but for uniformly drying a printed medium after ink on the medium has temporarily been dried.

SUMMARY OF THE INVENTION

An object of the present invention is to provide an ink jet printing apparatus which can perform uniform post-processing on a print medium by controlling an amount of heat generated by a thermal head according to a water volume in a print medium. More specifically, it is an object of this invention to provide an ink jet printing apparatus which controls the amount of heat generated by the thermal head and rationing of supply quantity by taking into account a water volume in the print medium that varies depending on an ink volume applied in the ink jet image printing process, a time which elapses from the image printing to the lamination, and an ambient temperature and humidity.

To achieve the above objective, the present invention has the following construction.

In an ink jet printing apparatus including a printing unit to form an image on a print medium according to an input image signal by using an ink jet print head having a plurality of nozzles for ejecting ink droplets and a protective layer forming unit to form a protective layer on the print medium printed with an image in the printing unit by applying heat energy to protective material to laminate an image-formed surface of the print medium, the present invention is characterized by a control means to control, in localized areas, the heat energy to be applied to the protective material according to a printing condition of the printing unit. With this construction, the post-processing operation that varies according to an image signal can be performed optimumly according to various printing conditions.

The thermal head is preferably able to change a range of heat applied to the protective material placed over the print medium. For example, the thermal head may have a plurality of heating elements capable of applying heat energy to individual pixels independently of one another, the pixels being printed by the print head. Each of the heating elements, when applied with an electric drive pulse, produces heat energy according to a waveform of the drive pulse.

The control means may control a waveform of a drive pulse applied to each of the heating elements according to the printing condition of the printing unit. For example, the control means may have a pulse width decision means which determines a width of a drive pulse applied to each of the heating elements according to the printing condition of the printing unit, or may have a pulse voltage decision means that determines a voltage of a drive pulse applied to each of the heating elements according to the printing condition of the printing unit.

The printing condition of the printing unit may be an ink volume applied to each of pixels making up an image formed on the print medium. This arrangement enables highly precise post-processing, assuring an excellent post-processed state.

The printing condition of the printing unit may also be a substitute parameter that permits an estimation of an ink volume ejected from each nozzle of the print head. This arrangement can deal with a situation where high-speed processing is required as during a high-speed printing operation.

The print head may have in each nozzle an electrothermal transducer as an energy generation means for ink ejection. In this case, the printing condition preferably includes a temperature of the print head or its vicinity. That is, in this case, not only the ink volume applied by the printing unit, but also the ambient temperature can be taken into account, assuring a more appropriate post-processing control.

The invention is also characterized in that a drying unit for drying the ink and water contained in the print medium is provided between the printing unit and the post-processing unit. With this arrangement it is possible to dry and remove an excess volume of water that was absorbed into the print medium during printing, thus expanding a latitude of the post-processing.

The invention is also characterized in that the printing condition of the printing unit is a substitute parameter that permits an estimation of an ink volume after the ink jet print head has been driven for printing. This arrangement permits both the control of the drying unit and the heat transfer control of the thermal head.

Further, the printing condition may include a driving state of the drying unit, such as a power consumption of the drying unit. With this arrangement, a control can be performed which considers dry state variations, making it possible to perform the post-processing control with high precision and thereby make up for insufficient drying states. The printing condition may also use a temperature of the drying unit.

In an ink jet printing apparatus including a printing unit to form an image on a print medium by an ink jet print head according to image data and a protective layer forming unit to apply a protective layer to an image-formed surface of the print medium printed with an image in the printing unit by applying heat energy generated by a thermal head to a protective material, the present invention is also characterized by a water volume estimation means to estimate a water volume contained in the print medium immediately before the protective layer is formed on the print medium in the protective layer forming unit, and a control means to change, in localized areas, heat energy to be applied to the protective material according to the water volume estimated by the water volume estimation means.

The water volume estimation means may estimate the water volume contained in the print medium immediately before the protective layer is formed on the print medium in the protective layer forming unit, based on an ink volume applied to the print medium in the printing unit and a water volume evaporated after the print medium has passed through the printing unit until it reaches the protective layer forming unit. With this arrangement, the post-processing unit can be controlled appropriately irrespective of the transport path length and transport speed of the print medium.

The water volume estimation means may estimate an evaporated water volume based on a time it takes from when the print medium has been printed by the printing unit until the print medium reaches the protective layer forming unit, and then estimate, based on the estimated evaporated water volume and an applied ink volume, the water volume contained in the print medium just before the protective layer is formed on the print medium in the protective layer forming unit.

The water volume estimation means may estimate the evaporated water volume based on an image length in a print medium transport direction and a time it takes from when the print medium has been printed by the printing unit until the print medium reaches the protective layer forming unit, and then estimate, based on the estimated evaporated water volume and an applied ink volume, the water volume contained in the print medium immediately before the protective layer is formed on the print medium in the protective layer forming unit.

The water volume estimation means may estimate an evaporated water volume based on the number of drive pulses for driving the thermal head and a time it takes from when the print medium has been printed by the printing unit until the print medium reaches the protective layer forming unit, and then estimate, based on the estimated evaporated water volume and an applied ink volume, the water volume contained in the print medium immediately before the protective layer is formed on the print medium in the protective layer forming unit.

This invention further includes a thermal head temperature detection means for detecting a temperature of the thermal head, wherein the control means changes, in localized areas, heat energy to be applied to the protective material according to the water volume in the print medium estimated by the water volume estimation means immediately before the protective layer is formed on the print medium in the protective layer forming unit and to the thermal head temperature detected by the thermal head temperature detection means.

The control means may change, in localized areas, heat energy to be applied to the protective material by taking into account at least one of an ambient temperature and an ambient humidity in addition to the water volume in the print medium estimated by the water volume estimation means immediately before the protective layer is formed on the print medium in the protective layer forming unit and the thermal head temperature detected by the thermal head temperature detection means.

The water volume estimation means may estimate the water volume contained in the print medium for each area of a predetermined size. For example, the water volume contained in the print medium immediately before the protective layer is formed on the print medium in the protective layer forming unit may be estimated for each of a plurality of areas that are defined by dividing the print medium in two directions, a print medium transport direction and a direction crossing the first direction. It may also be estimated for each of a plurality of areas that are defined by dividing the print medium in a print medium transport direction.

As described above, when, after forming an image on a print medium using an ink jet print head, a protective layer is to be formed over an image-formed surface of the print medium by a heat transfer method, this invention estimates a water volume contained in the print medium and, based on the estimated water volume, controls the operation of the thermal head. This ensures an appropriate formation of the protective layer.

The above and other objects, effects, features and advantages of the present invention will become more apparent from the following description of embodiments thereof taken in conjunction with the accompanying drawings.

BRIEF DESCRIPTION OF THE DRAWINGS

FIG. 11 is a table showing water volume numbers applied to the fourth embodiment of the invention;

FIG. 12 is a table showing Pop numbers applied to the fourth embodiment of the invention;

FIG. 13 is a table showing Pop number vs. drive voltage application time used in the fourth embodiment of the invention;

FIG. 21 is a water volume number table for determining a water volume number for each unit area in the fourth embodiment of the invention;

FIG. 23 is a water volume number table for determining a water volume number in the fifth embodiment of the invention;

DETAILED DESCRIPTION OF PREFERRED EMBODIMENTS

Now, embodiments of the present invention will be described by referring to the accompanying drawings.

(First Basic Construction)

A first basic construction of an ink jet printing apparatus embodying the present invention will be explained.

Figure 1:
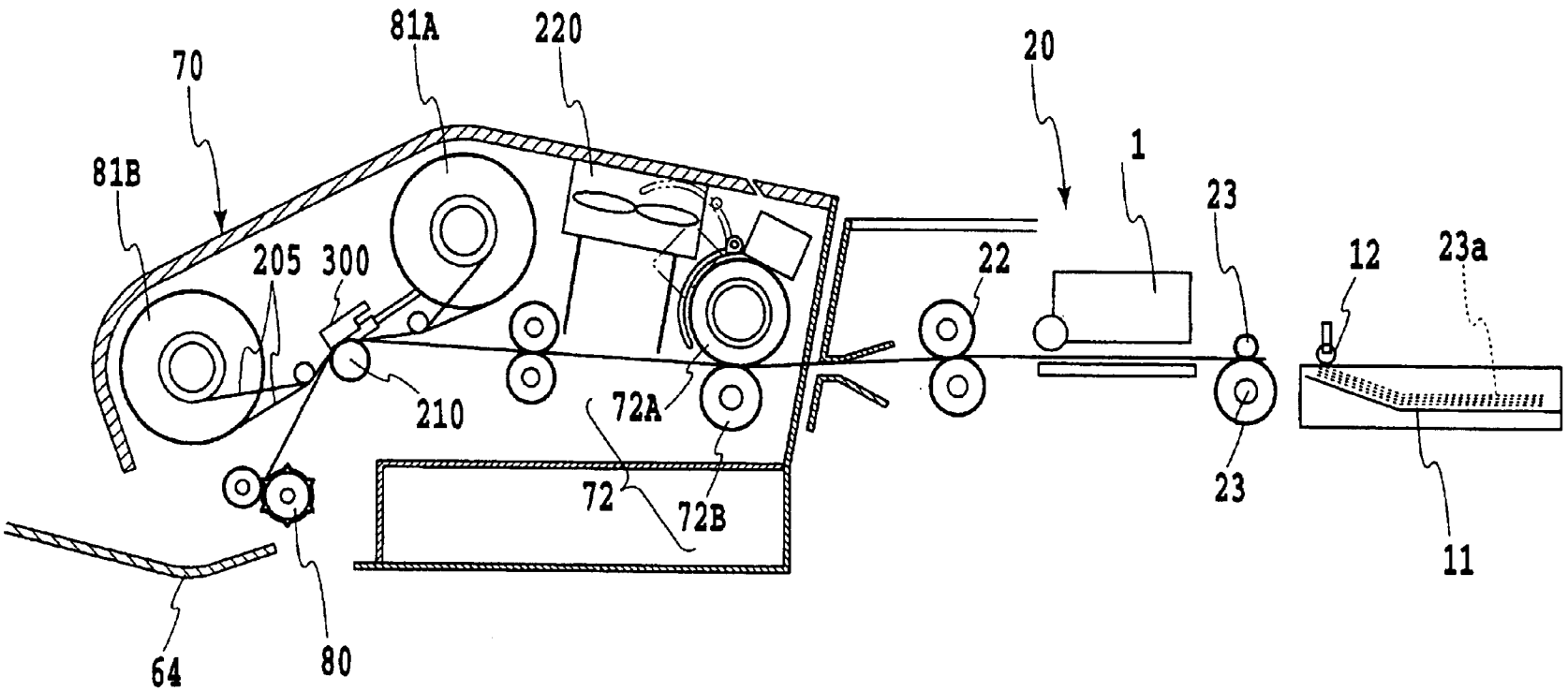
FIG. 1 is a vertical, side cross-sectional view showing a first basic construction of an ink jet printing apparatus embodying the present invention.
Figure 24:
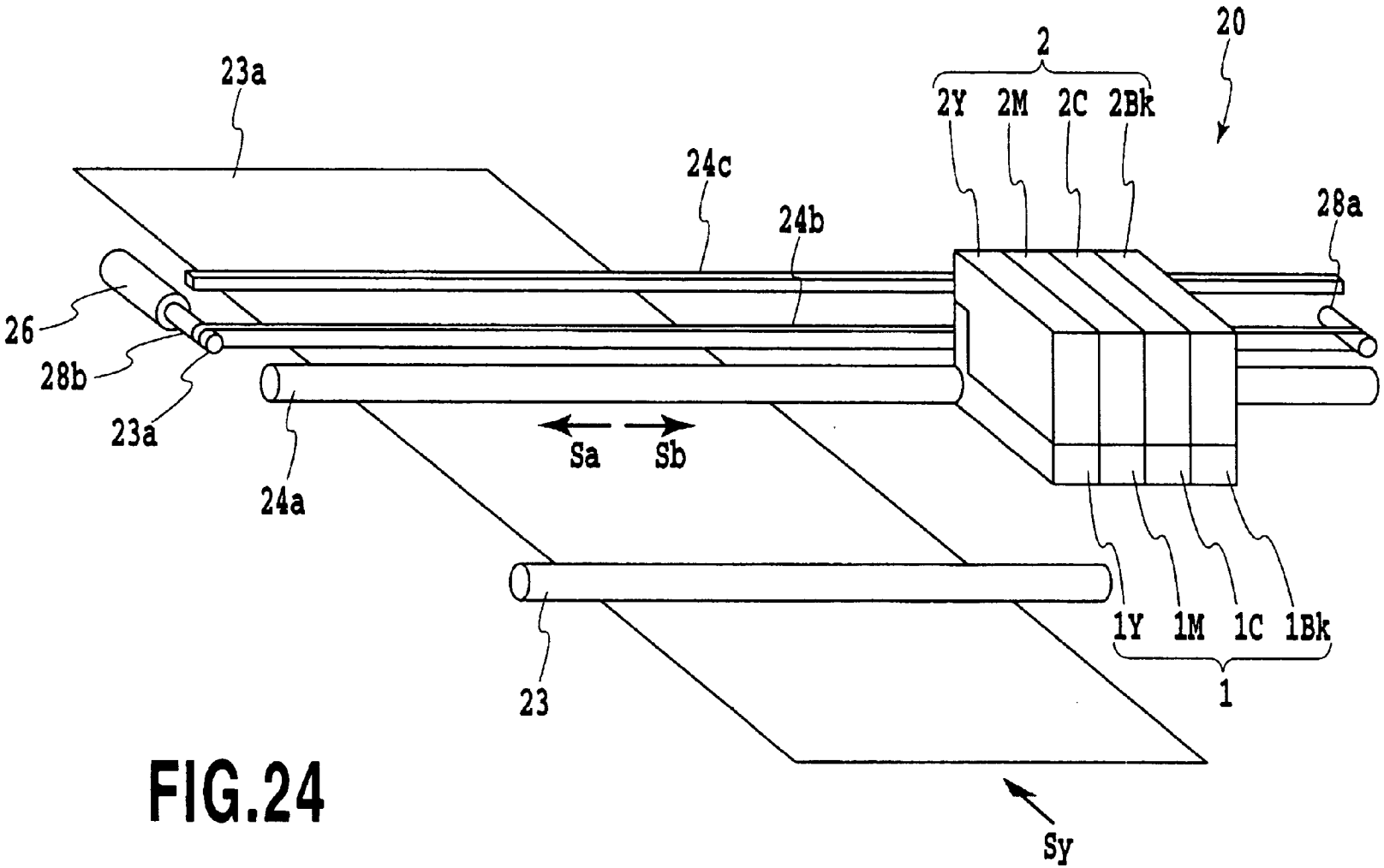
FIG. 24 is a perspective view schematically showing a construction of a printing unit of a commonly used, conventional ink jet printing apparatus.

FIG. 1 is a vertical, side cross-sectional view showing a basic construction of an ink jet printing apparatus applied to this embodiment. In FIG. 1, a printing unit of the image forming apparatus is almost similar to the one described in connection with FIG. 24. That is, it has a so-called serial printer type construction in which an image is formed on a print medium 23*a* by reciprocally moving the print head 1 employing an ink jet printing method over the print medium 23*a* in the main scan direction along a guide shaft 24*a* while at the same time intermittently feeding the print medium 23*a* in a sub-scan direction. The construction of the printing unit itself is well known and further explanation of it will be omitted.

The print media 23*a* to be printed by the printing unit 20 are stacked in a cassette 11. In an image forming process, a print medium 23*a* is supplied by a supply roller 12 from the cassette 11 and intermittently fed a predetermined distance by the transport rollers 23 according to the time the print head 1 is reciprocally moved to form an image. Downstream of the printing unit 20 in the medium transport direction is provided a pair of transport rollers 22 that feed the print medium 23*a* toward the post-processing unit (protective layer forming unit) 70. Near the inlet of the post-processing unit 70, a pair of drying rollers 72A, 72B are installed. As it passes through a medium holding portion of the drying rollers (also referred to as a nip), the print medium 23*a* is dried and further advanced inwardly by the drying rollers. Water vapor produced here is exhausted out of the apparatus by an exhaust fan 220.

The print medium that has passed through the drying rollers 72A, 72B is then transported toward a nip between the thermal head 300, which serves as heating means for generating the heat to transfer the transfer film onto the print medium, and the platen roller 210. A heat transfer film 205 is wound on the supply roller 81A. The heat transfer film 205 paid out from the supply roller 81A is guided between the thermal head 300 and the opposing platen roller 210 before being wound up by the takeup roller 81B. The transfer film is constantly applied with a uniform tension as by a biasing force of an idle roller to make it wrinkle-free. The transfer film is made by laminating a transparent, heat-melting resin layer on one side of a heat-resistant base material of, for example, polyethylene terephthalate (PET).

The print medium that has reached the nip between the thermal head 300 and the platen roller 210 has its printed surface come into contact with a transparent resin layer of the transfer film. This transparent resin layer is thermally transferred onto the surface of the print medium by the heat of the thermal head 300. The print medium laminated with the transparent resin layer is then discharged onto a paper discharge guide 64 by a rear discharge roller 80. The base material of the transfer film, with its transparent resin layer transferred onto the print medium, is now wound up on the takeup roller 81B.

Inside the drying roller 72A, a cylindrical heater is arranged concentrically with a circumferential surface of the drying roller 72A to heat the roller surface to dry ink. In this embodiment, a halogen heater commonly used for a fusing process in the electrophotographic printing is employed as the cylindrical heater. This heater, however, needs only to heat the circumferential surface of the drying roller almost uniformly and is not limited to the construction shown. For example, the heater may be provided outside the drying roller to controllably heat the roller surface.

The thermal head 300, platen roller 210 and heat transfer film may be from among those conventionally available and are not limited to a particular construction. It is noted, however, that the transfer film is preferably made of a transparent, colorless material (i.e., not including a coloring substance). Further, if the transfer film is mixed with an ultraviolet ray absorbing material, the weatherability of the print medium can further be enhanced.

An image formed by the ink jet printing, if stacked or touched immediately after the output, may cause ink not yet dried to smear the printed image or other parts. When a high-speed printing is performed, since a liquid (ink) containing a large amount of water lands on the surface of the print medium, parts of the print medium that have received the liquid may elongate temporarily or the elongated parts may shrink upon starting to dry quickly, causing the print medium to curl or wave, impairing a texture of the printed material or degrading a stacking performance of the discharge unit of the printing apparatus. This problem has been found to be effectively alleviated by providing a drying means after the ink jet printing and before the post-processing.

In a printing apparatus which, after the printing operation, automatically performs the post-processing (hereafter referred to also as a lamination) to cover the print medium with a film as described above, it is a conventional practice to laminate a transfer film over the print medium still in a wet condition, i.e., while the medium still contains a liquid such as ink. This poses a variety of problems. For example, during the lamination process an ink solvent such as water evaporates to form bubbles between the lamination film and printing medium. Or after lamination, ink moves (bleeds, spreads, or sinks) on the printing medium (ink receiving layer) under the bottom of laminate layer due to wet ink, a so-called migration phenomenon, which in turn leads to various problems such as hue changes. Therefore, a drying means provided in this embodiment can eliminate or minimize the occurrence of the above-described phenomenon.

Some print media have a paper base material coated with a coating material at its back, which allows water to soak into the base material from the front surface, but prevents water from evaporating from the back surface. In such a case, the water entering into the paper base material is trapped therein, promoting the occurrence of the migration phenomenon. Generally, such a back coat is often used on high-quality paper designed to improve water resistance, gas resistance and ozone resistance and make the print medium texture look like a silver salt photographic paper.

Figure 25:
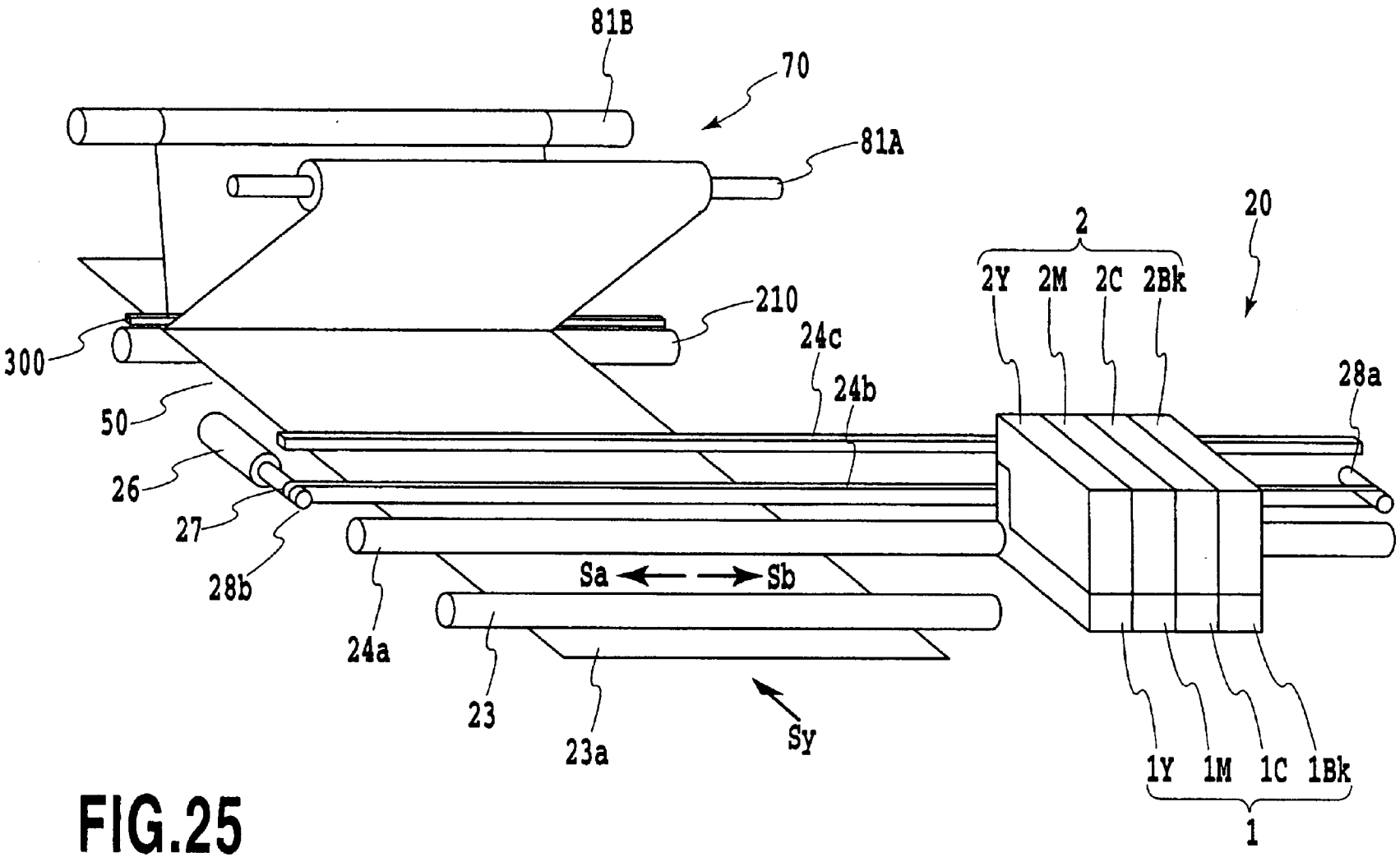
FIG. 25 is a perspective view schematically showing a conventional printing apparatus having a post-processing unit for lamination.

In the above construction, an example case has been explained in which a drying unit (drying rollers 72A, 72B) is provided in the post-processing unit 70. This drying unit is not essential in the characteristic construction of this invention described later and may be omitted. For example, the present invention can also be applied to an ink jet printing apparatus with no drying unit, as described in the conventional example (explained in connection with FIG. 25).

(First Embodiment)

Next, a first embodiment of the characteristic construction according to the present invention will be explained by referring to the accompanying drawings. The first embodiment has the first basic construction described above.

The first embodiment calculates or estimates the amount of ink to be ejected onto individual pixels by the ink jet head. Based on this estimation, the drive condition of the thermal head is determined to make a thermal energy used in the post-processing unit large when the ink ejection volume estimated is large and, when it is small, make the energy to be applied small. That is, the ink ejection volumes are counted for each color pixel and the thermal head performs an energy control according to the printed pattern of pixels.

Figures 2A, 2B, 2C:
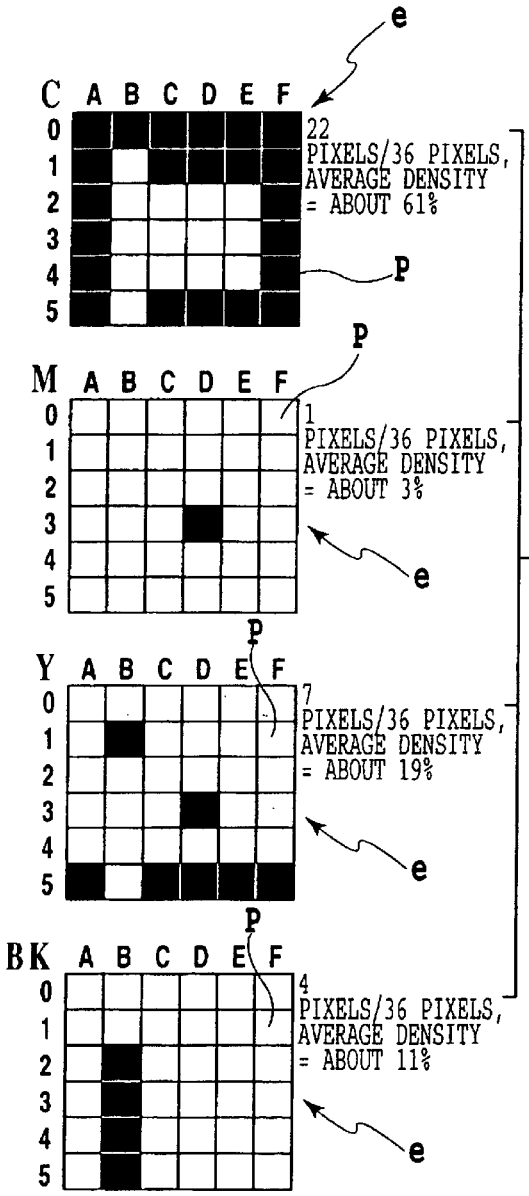
FIGS. 2A to 2C comprise an explanatory diagram showing printed patterns of individual inks printed by a print head and total densities at individual pixels in the first embodiment of a characteristic construction according to the present invention.

By referring to FIGS. 2A to 2C, the feature of this embodiment will be described in more detail. FIGS. 2A to 2C comprise an explanatory diagram showing print patterns printed with individual inks by the print head and total densities for individual pixels.

In FIG. 2A a simplified 6×6-pixel image, i.e., (A to F columns)×(0 to 5 lines), is shown which represents the Japanese flag, on a background of blue sky and lawn. This image is separated into C (cyan), M (magenta), Y (yellow) and Bk (black) patterns as shown, with blackened pixels, P, in each color representing those where dots are formed and with blank pixels, P, representing those where dots are not formed.

In FIGS. 2A to 2C, in the area of 36 pixels, 22 dots are formed with C ink, 1 dot with M ink, 7 dots with Y ink and 4 dots with Bk ink. That is, if printing one dot at every pixel on the entire area is taken to be a 100% duty (solid printing), then the images formed by individual colors have duties of 61%, 3%, 19% and 11%, respectively, and their total duty is 94%. This represents a state in which the printed medium has a smaller water volume than when a single color printing is performed with 100% duty.

Basically, in image processing using C, M, Y and Bk inks, the maximum applicable ink volume for the print medium needs to be set in a duty range of around 180% to 250% in order to reproduce R, G, B colors or so-called secondary colors. The image with 150–200% duty is said to have a relatively high duty.

Thus, the printed area of FIG. 2A is not applied with enough ink dots as will provide a high duty. If the ink application volume is too large compared with the ink absorption capability of the print medium, a satisfactory result may not be obtained in terms of vividness and crispness and of graininess. In the case of the image of FIG. 2A, which is formed with dots with an average duty of 94%, there is no conspicuous problem. However, when dots of each color in FIG. 2A are actually applied to an area of 6×6 pixels, the total number of dots applied to each pixel P is as shown in FIG. 2B. It is noted that nearly all pixels P of the bottom row (at a bottom part of the image corresponding to fifth line) have a 200% duty, with the central part of the image (every pixel around the pixel at the third line, Dth column) almost not printed. If these pixels P undergo the thermal transfer processing without being dried, that is, if the operation of the thermal head is controlled (a drive pulse for the thermal head heater is set) based on the pixels P with a low water content, the thermal transfer may fail to be performed normally at only the bottom row pixels (fifth line), resulting in the corresponding part of the laminate layer (protective layer) being broken open.

Hence, in this first embodiment, the thermal head operation is controlled according to pixels with a high duty. That is, where the accumulated dot number for each pixel P is either 2, 1 or 0, as shown in FIG. 2B, the corresponding dot drive pulse widths or energy quantities used to control the thermal head operation were set to 100%, 91% and 82%, respectively, as shown in FIG. 2C. This control resulted in a satisfactory thermal transfer for all pixels. As to the driving condition for this control, a standard value was 0.198 mJ/dot, which matches a 200% duty. The application of the first embodiment expanded a heat transfer latitude (a range of energy applied per dot in which the heat transfer can be performed appropriately) from 0.04 mJ/dot, a value obtained when the first embodiment is not applied, to 0.08 mJ/dot. This means that it is possible to better cope with a variety of kinds of print media and transfer films and variations of environment.

As described above, since the first embodiment employs a thermal head as a heating means in the post-processing unit 70, the individual pixel heating is made possible. This constitutes an important feature of the first embodiment.

It is noted, however, that the present invention does not make the control for individual pixels an essential requirement and various control methods may be adopted. For example, it is possible to perform control based on an average duty in an entire area and only increase the amount of heat of the thermal head when the overall average duty is near 200%. It is also possible to monitor a maximum water content in each pixel. Performing these controls enables the heat transfer to be performed in a more desirable condition. In the above embodiment, for the sake of simplification of the explanation, each of a pixel as a minimum unit of resolution of the printing section and an area as a minimum unit of resolution capable of independent driving of the thermal head is referred to as a pixel on the assumption that the pixel matches the area. Here, of course, as has been stated above, it is not necessary for the pixel to match the area. For example, when the resolution of the printing section is 1200 dpi and the resolution of the thermal head is 300 dpi, a block area consisting of 4×4 pixels corresponds to a control area of the thermal head. It is easy to control the thermal head by means of operation even if the number of dots in the printing section is indivisible by an integer.

In this embodiment a drying unit comprising the paired drying rollers 72A, 72B is installed between the printing unit 20 and the post-processing unit 70 in order to prevent water trapped between the laminate layer and the print medium during the lamination processing from degrading an image quality or causing a cockling or waving in the print medium. Even with the print medium passed through the post-processing unit 70, there are pixels with large total ink volumes and pixels with small total ink volumes, and these pixels have differing water content (residual water content) and differing surface temperatures, making it impossible to produce a uniform laminated state.

This problem can be dealt with by slowing down the transport speed of the print medium in the drying unit to apply enough heat to the print medium but at a temperature low enough to keep it from burning. This will vaporize almost all water in the drying process, stabilize the residual water content and thus make the surface temperature uniform. In the ink jet printing apparatus, however, it is required that the power consumption and the apparatus installation space be made as small as possible and the printing operation as fast as possible. From this point of view, reducing the print medium transport speed in the drying unit is not undesirble. Therefore, even if a drying unit is provided as in this first embodiment, it is desired to estimate a water content in the print medium from a total applied ink volume calculated based on image data and to control an energy to be applied from the heat transfer head to the print medium according to the estimation to make the residual water content in the print medium uniform. These controls assure a uniform lamination state while minimizing an increase in power consumption and a reduction in the transport speed.

(Second Embodiment)

Next, a second embodiment of the present invention will be described. The second embodiment has the first basic construction shown in FIG. 1.

The second embodiment is characterized in that the drive energy (drive pulse width, etc.) to be applied to the thermal head 300 is controlled by a temperature of an ink chamber or substrate of the ink jet print head 1. This control may involve storing a temperature pattern of the substrate for every sub-scan operation and correcting the driving of the thermal head 300 when the print medium is supplied.

In this embodiment, the explanation concerns a case where the thermal head 300 of the ink jet printing apparatus shown in FIG. 1 is controlled based on the temperature of the substrate in the print head 1.

Figure 3:
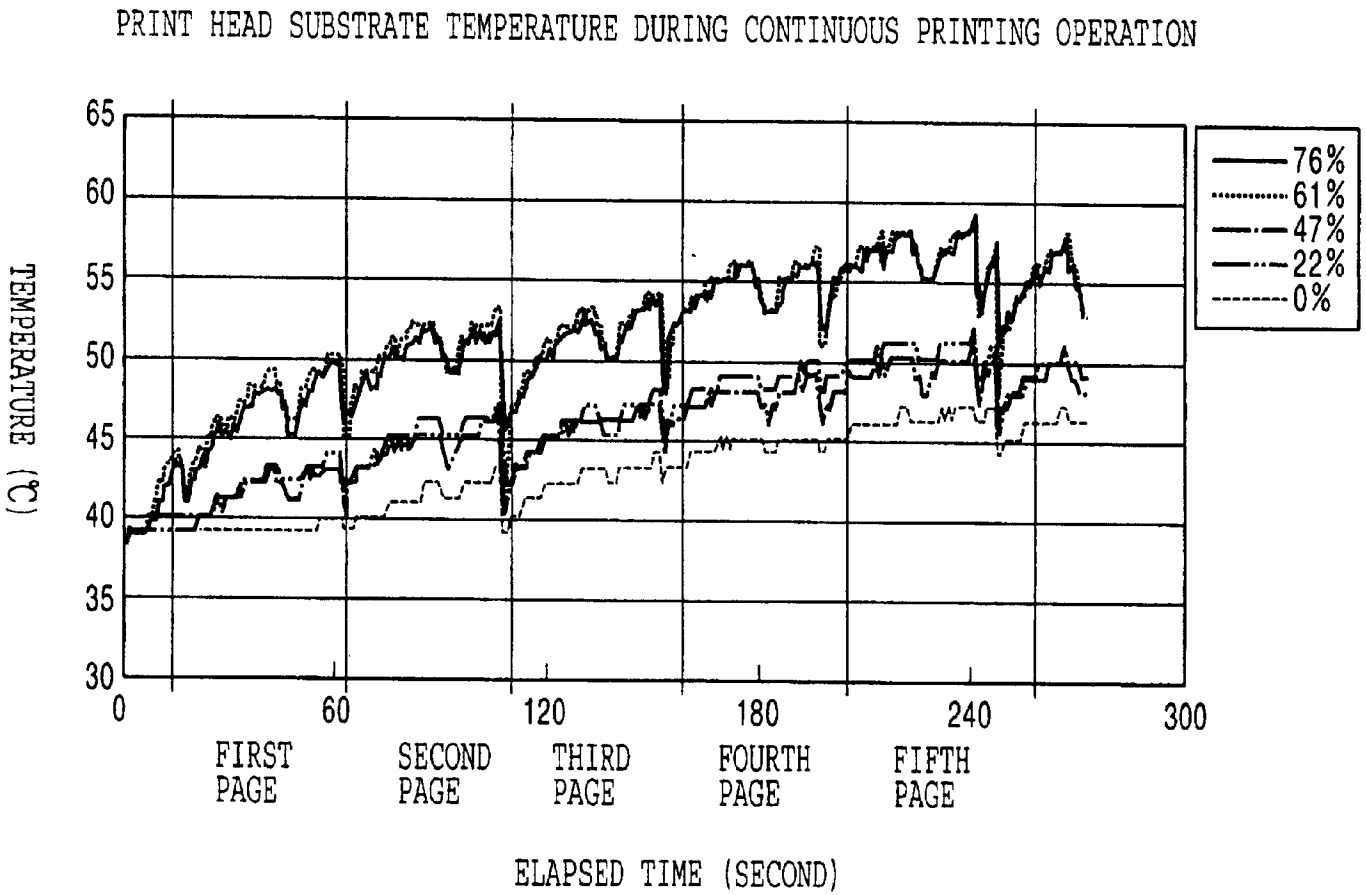
FIG. 3 is a graph showing, for each of different print duties, how a temperature of a substrate of the print head 1 used in this embodiment rises during a continuous printing operation.

FIG. 3 is a graph showing, for each printing duty, how the substrate temperature in the print head 1 used in this embodiment rises as the continuous printing operation proceeds. The print head temperature before the printing operation depends greatly on the ambient temperature, and in this embodiment it is assumed that the substrate temperature before the printing starts is equal to the ambient temperature. In the example shown, the substrate temperature prior to the printing operation is 35° C.

Controlling the drive pulse for the thermal head 300 according to an ambient temperature at the start of the operation of the thermal head 300 has already been proposed in a known example described in the related art section, and thus its detailed explanations are omitted. It is a common practice to control the drive pulse to reduce the applied energy when an ambient temperature is high and to increase it when the ambient temperature is low. In this embodiment, a drive pulse controlled in this manner is used as a standard and also corrected according to information on the ink volume applied to each pixel.

That is, in this embodiment, temperatures after the first page has been printed are summed up for each color and the printed medium is determined to have a low density when a total temperature of all four colors is less than 165° C., a medium density when the total temperature is in a 165–170° C. range and a high density when it is more than 170° C. These decision results are matched to the total dot counts 0, 1 and 2, respectively, to set the duties of the drive pulse of the thermal head 300 for the corresponding temperatures to 82% (low duty), 91% (medium duty) and 100% (high duty). Using these duties, the control is performed in a manner similar to the first embodiment described above.

In this control, when during the continuous printing operation the temperature of the print head 1 rises, the total temperature also rises. In this case, the thermal head 300 is also driven continuously and therefore its temperature also increases, making it necessary to set the drive pulse energy to be applied to the second and succeeding pages lower than that applied to the first page. In this second embodiment, since the control is performed based on the detected temperature of the substrate in the print head 1, the control takes into account a temperature change in the thermal head 300 resulting from the continuous processing of printed media.

Therefore, there is no need to provide a special counter for obtaining an operation history of the print head 1 or thermal head 300 and accumulate dot application data. Further, since this control can combine the printed states for all colors into a single parameter, it offers an advantage of being able to simplify the control. Another advantage is that since this control also uses parameters associated with a mechanical structure (mechanical structure temperatures) in addition to the parameters based on the image data, a more effective control is possible. Particularly, if the temperature rise of the substrate is finely logged with high precision, it is possible to determine whether the current printing is part of a continuous one or a discrete, independent one and to include this drive status in the control.

(Third Embodiment)

Next, a third embodiment of the present invention will be described. The third embodiment has the first basic construction.

The third embodiment is characterized in that, in an ink jet printing apparatus having a drying unit 72 (drying rollers 72A, 72B) installed in a print medium transport path between the printing unit 20 and the post-processing unit 70, the ink volume applied from the ink jet print head 1 or the water content in the print medium 23*a* is detected by measuring a temperature change in the drying unit 72 or a power consumption change and, based on the detected result, the drive condition of the thermal head 300 (drive pulse width, etc.) is determined.

In other words, since the third embodiment can use the state of a print medium immediately before being inserted between the thermal head 300 and the platen roller 210 in the control of the thermal head 300, not only is the time variation factor small, but the control can take into account a state in which the drying temperature (amount of evaporation) is slightly lower than necessary. Another advantage of this embodiment is the ability to include, in advance, even the water content in the print medium 23*a* in the thermal head control.

Figure 4:
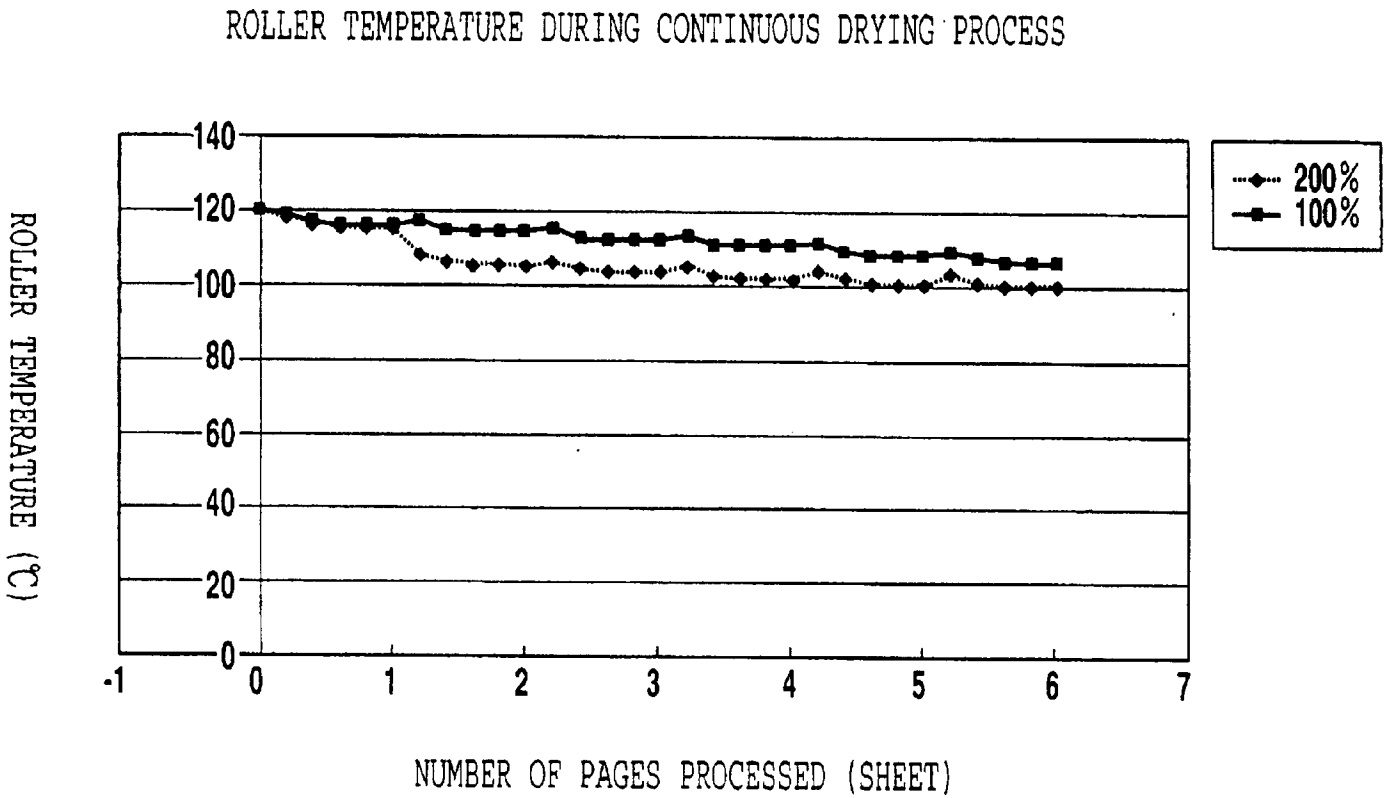
FIG. 4 is a graph showing a relation between a surface temperature of a drying roller and the number of print mediums passed through the roller when the ink jet printing apparatus of FIG. 1 is continuously driven.

In the image forming apparatus of FIG. 1, a relation between a surface temperature of the drying roller 72B and the number of mediums processed during a continuous operation is shown in FIG. 4.

The temperature of the drying roller 72A is controlled at 140° C. and a heater is installed in only one drying roller 72A, not in the opposite roller. Further, the drying roller 72A is heated and stabilized at an adjusted temperature (140° C.) and rotated three or more turns to have its temperature uniformly distributed before processing the print medium. The opposing drying roller 72B is also subjected to a similar temperature stabilizing warm-up before the printing and drying processes are started.

This warm-up operation makes it possible to measure more reliably a reduction in the surface temperature of the drying roller 72B resulting from the print medium processing. The number of rotations required in this warm-up is not limited to any particular number because it depends on the construction used. It is also noted that this warm-up or preliminary operation is not essential to the control action characteristic of the present invention.

While in the third embodiment a measurement is taken of the surface temperature of the drying roller 72B which is not temperature-controlled, the present invention is not limited to this configuration. For example, a thermistor may be installed on that part of the drying roller 72A which is not in contact with the print medium or at an end portion of a center core to detect a reduction in the surface temperature of the medium contact portion of the roller. Alternatively, a measurement may be made of energy consumption caused by an increase in the driving power of the heater in the drying roller 72A.

When, under the same environment, print media 23*a* with different print densities are passed through the drying unit 72, it is seen from FIG. 4 that the print medium with a higher print density (a larger volume of applied ink) causes a greater reduction in the roller temperature. However, if print media to be processed have the same print densities (same ink volumes), the temperature drop of the drying unit 72 is larger when an ambient humidity is low than when it is high. This phenomenon becomes more distinguished as the ink volume applied increases. With the third embodiment, since the driving of the thermal head is controlled according to ambient humidity variations in the drying unit, the thermal head control can cope with water volume variations in the print medium caused not only by ink application variations, but also by ambient humidity variations.

In other words, unlike other embodiments which estimate energy required for the post-processing from the environmental and printing conditions, the third embodiment measures the energy consumed by the drying unit 72 to determine the amount of energy required for the post-processing immediately before the post-processing (heat transfer processing) is performed. Here, for simplified explanation, temperature variations of the drying roller resulting from environmental humidity variations are assumed to be within a measurement error and are not represented as a fine control value.

In the third embodiment, a comparison was made in terms of the heat transfer latitude between a portion printed with a 200% high density image which is equivalent to applying two dots in one pixel under a low humidity environment and a portion corresponding to a blank area formed with almost no image under a high tumidity environment. It was found that these latitudes are nearly equal.

When print media are to be laminated in these high and low humidity environments, the thermal head 300 may be controlled using values read from a plurality of different tables. However, in the third embodiment, since the values for directly controlling the thermal head 300 (e.g., drive pulse width or voltage) are determined from parameters in the drying unit (e.g., temperature or power consumption), the number of tables required can be reduced, simplifying the control. Further, the third embodiment can also deal with ink application volume variations caused not only by a temperature rise of the print head during a continuous operation of the printing unit, but also by ejection failures or improper ejections. Even under these problematical conditions, the third embodiment can perform a proper control of the thermal head without requiring a complex parameter conversion, which in turn leads to a cost reduction of the control system.

(Second Basic Construction)

A second basic construction of the ink jet printing apparatus of the present invention will be described by referring to FIG. 5 to FIG. 9.

Figure 5:
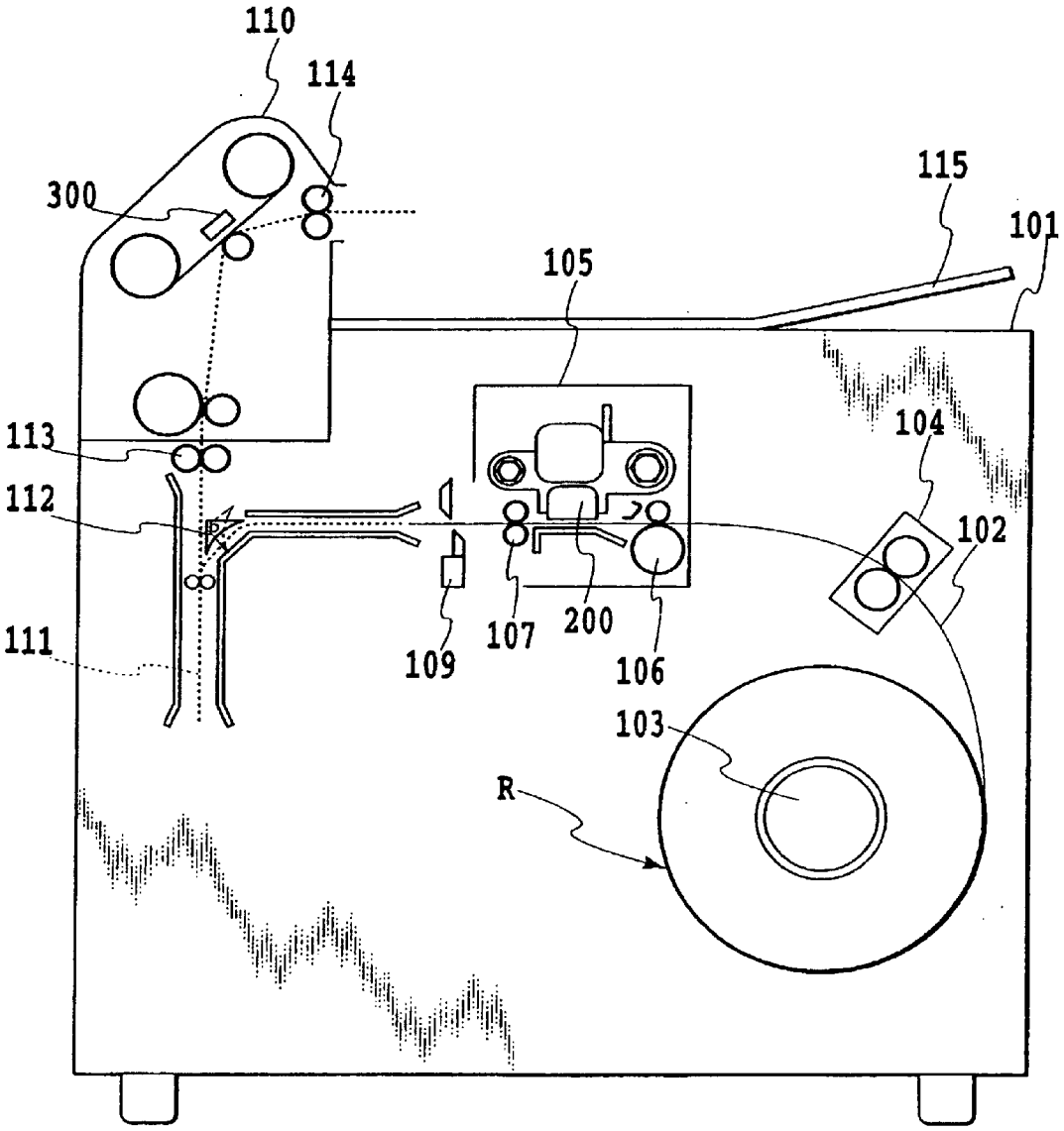
FIG. 5 is a vertical, side cross-sectional view showing a second basic construction of an ink jet printing apparatus embodying the present invention.

In FIG. 5, denoted by reference numeral 101 is an ink jet printing apparatus, which mainly comprises a roll R for supplying a print medium, a printing unit 105 for printing on a print medium 102, and a post-processing unit 110 for laminating a surface of the printed medium with a protective layer.

The roll R has a print medium wound, printing side out, on a cylindrical core tube 103 and is rotatably supported on a shaft (not shown) inserted through the core tube 103. The print medium on the roll R is fed toward the printing unit 105 by a pair of feed rollers 104.

The printing unit 105 has a serial printer type printing mechanism, in which the print medium 102 fed from the feed rollers 104 is clamped and moved by a pair of transport rollers 106 and a pair of auxiliary transport rollers 107 while at the same time the print head is reciprocally moved to form an image. The print medium 102 that is printed with an image is output into a transport path and cut to a predetermined length by a cutter unit 109.

The print medium 102 cut by the cutter unit 109 is fed through the transport path to the post-processing unit 110. The post-processing unit 110 performs a lamination as post-processing on the print medium 102 printed by the printing unit 105. In the printing unit 105, the print medium 102 is advanced by an arbitrary pitch each time the print head 200 completes a serial scan. In the lamination process by the post-processing unit 110, however, the print medium 102 is transported continuously at a constant speed. Since the print medium transport action differs between the printing process and the post-processing, one sheet of print medium cannot be moved simultaneously through these two processes. For a size reduction of the printing apparatus, a spacing between the printing unit 105 and the post-processing unit 110 is normally set short, so that the length of the print medium 102 fed out from the printing unit 105 may exceed that spacing. Therefore, the ink jet printing apparatus of the second basic construction has, in the transport path between the printing unit and the post-processing unit, a buffer area 111 that bends downward as shown. The print medium 102 fed from the printing unit is temporarily accommodated into the buffer area 111 and, upon completion of the printing action, is cut off from the rolled sheet by the cutter unit 109 before being transported at a constant speed to the post-processing unit 110. The switching of the transport direction of the print medium 102 is performed by a flapper 112.

More specifically, the print medium 102 cut by the cutter unit 109 is guided into the buffer area 111 by the flapper 112 at a position indicated by a solid line in the figure. Then the flapper 112 is pivoted to a position indicated by a one-dot chain line to switch the transport direction of the print medium, allowing the printed medium to be fed by a transport roller pair 113 to the post-processing unit 110. In this post-processing unit 110, the print medium 102 undergoes the lamination processing and is then discharged by a discharge roller pair 114 onto a discharge tray 115, where subsequent printed media are stacked one upon the other.

Figure 8:
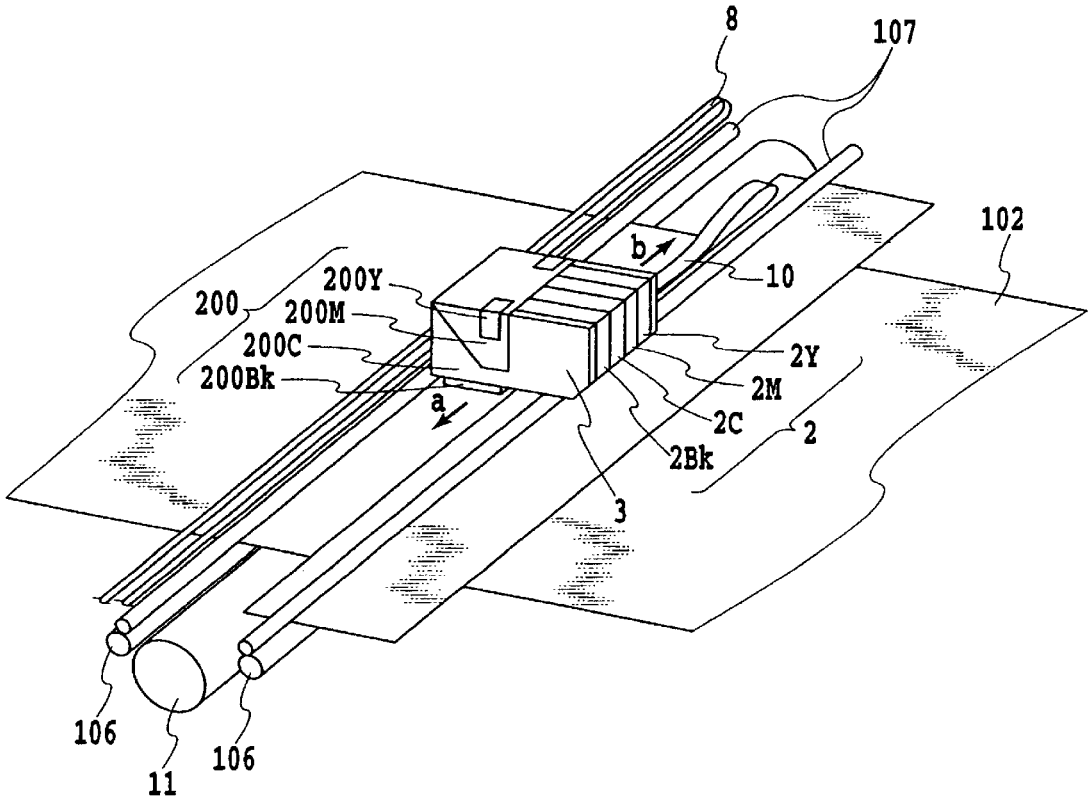
FIG. 8 is a perspective view showing an example of a detailed construction of a printing unit of FIG. 5.

A detailed construction of the printing unit 105 is shown in FIG. 8.

The printing unit 105 is an ink jet printing apparatus with a print head that employs the so-called Bubble Jet (tradename) printing method, in which a bubble is generated in ink by thermal energy to expel an ink droplet by the pressure of the bubble as it grows. The printing unit 105 also constitutes a serial type color ink jet printing apparatus.

In FIG. 8, designated by reference numeral 3 is a carriage that removably mounts ink tanks 2Bk, 2C, 2M, 2Y containing Bk (black), C (cyan), M (magenta) and Y (yellow) inks, respectively, and print heads 200Bk, 200C, 200M, 200Y that eject inks supplied from these ink tanks. In FIG. 8, print heads other than the black print head 200Bk are not shown because they are hidden behind the carriage 3.

A scan speed and printing position of the carriage 3 are detected by a position detector (not shown) and, based on the detection result, the movement of the carriage 3 in the main scan direction is controlled. A power source for the carriage 3 is a carriage drive motor, whose driving force is transmitted through a timing belt 8 to the carriage 3, which is then moved along a guide shaft (not shown) in the direction of arrows a, b.

During the main scan operation of the carriage 3, the print heads 200 eject different color inks according to print data supplied from an electric circuit of the printing apparatus body through a flexible cable 10. Ink droplets ejected onto the print medium 102, when seen in combination, produce a color image.

A platen roller 11, disposed between the paired transport rollers 106 and the paired auxiliary transport rollers 107, supports the print medium 102 as it is transported, and also establishes a planar surface of the print medium with respect to the print heads 200 over an entire main scan of the carriage 3.

Figure 9:
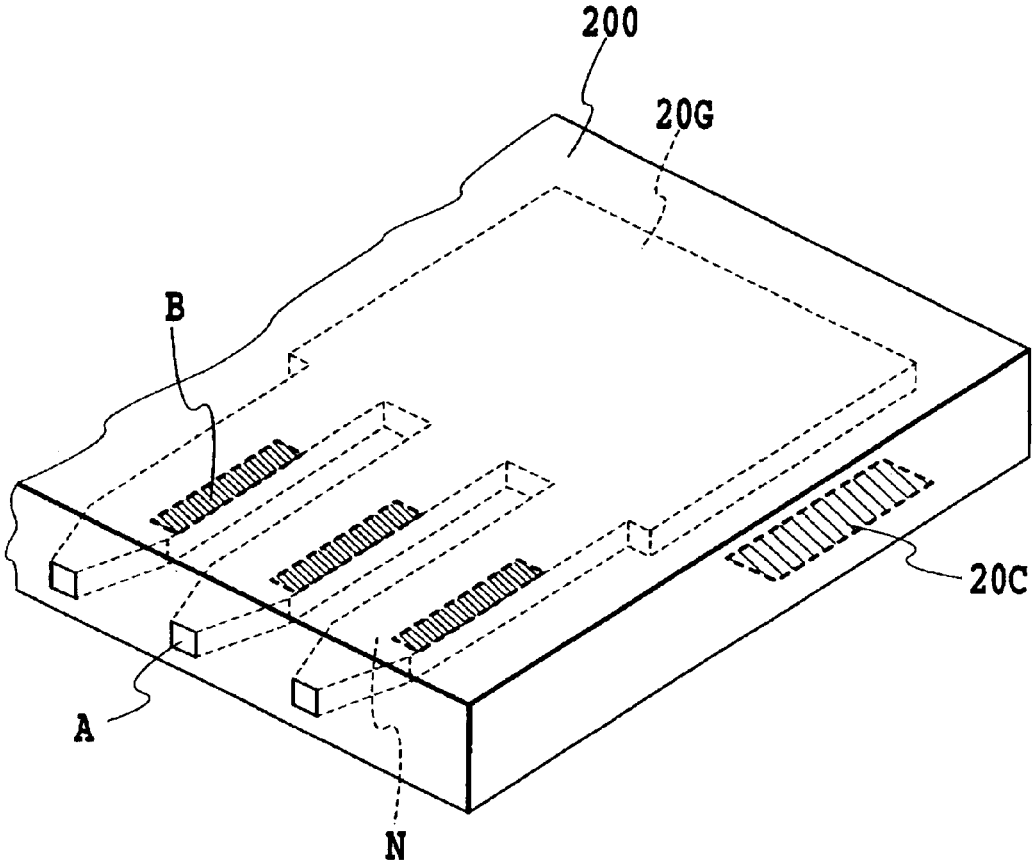
FIG. 9 is a perspective view showing a print head applied to the second basic construction of the invention.

Next, a construction of one of the print heads 200 as applied to the second basic construction will be explained with reference to FIG. 9.

The print head 200 has an array of nozzles N for ejecting ink droplets. In each nozzle N, an electrothermal transducer B (also referred to as an ejection heater) for converting electric energy to thermal energy is arranged on a heater board 20G. The ejection heater B is applied with a drive pulse as electric energy according to image data. This drive pulse energizes the ejection heater B to generate heat, which then transforms ink directly above the ejection heater B from liquid to gas, causing a rapid volume expansion. This, in turn, produces an impulse wave that ejects an ink droplet out of an opening A. Denoted by reference numeral 20C is a diode sensor which detects a temperature of the print head 200.

Each of the print heads 200 has a memory means (not shown) to store a variety of characteristic information. The memory means stores, for example, rank information representing ink ejection volumes that differ among individual print heads and information on drive pulse widths optimum for particular shapes of ejection heaters which may vary from one print head to another. The printing apparatus retrieves such information, and adjusts an output gamma during the image printing operation and optimizes the operation of the print heads 200 according to the retrieved information.

While the printing unit described in the above example employs the ink jet print head utilizing thermal energy, the printing method is not limited to this configuration. For example, the present invention can also be applied to a case where ink is ejected from the nozzles by electromechanical transducers, such as piezoelectric elements, which produce a mechanical change upon application of electric energy.

Next, a construction of the post-processing unit 110 in the ink jet printing apparatus shown in FIG. 5 will be explained by referring to FIG. 6 and FIG. 7.

Figure 6:
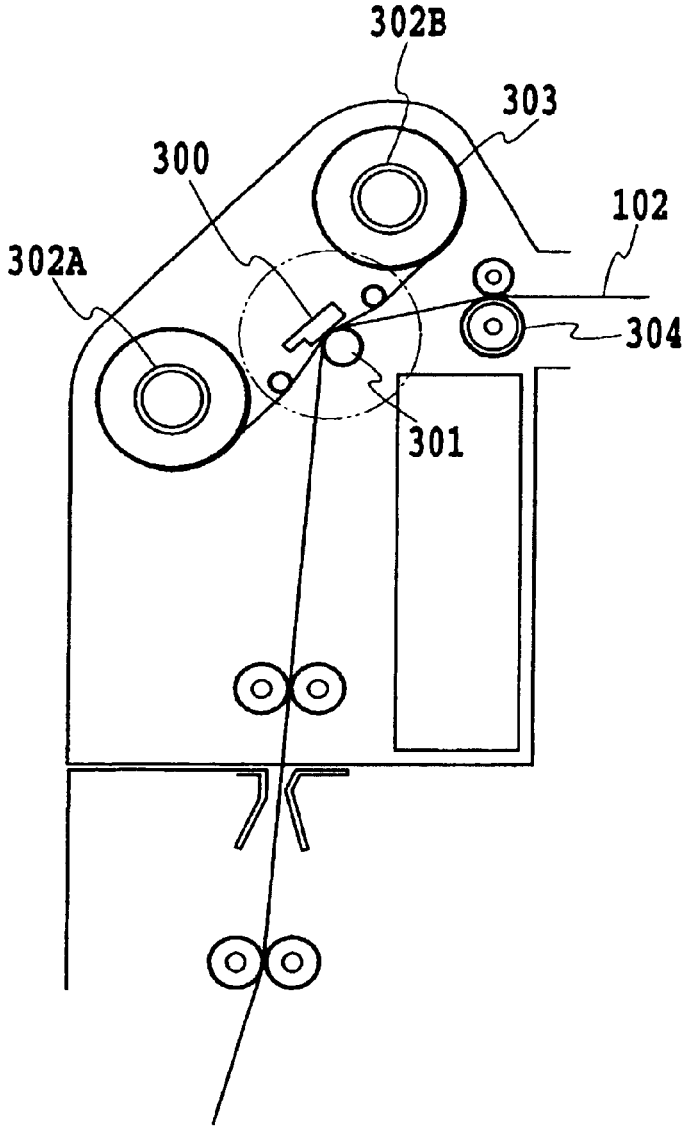
FIG. 6 is an enlarged side view showing details of a construction of the post-processing unit (protective layer forming unit) of FIG. 5.

FIG. 6 is an enlarged side view showing a detail of the construction of the post-processing unit 110 of FIG. 5. FIG. 7 is a perspective view conceptually showing a portion of FIG. 6 enclosed in the circle of the two-dot chain line.

Figure 7:
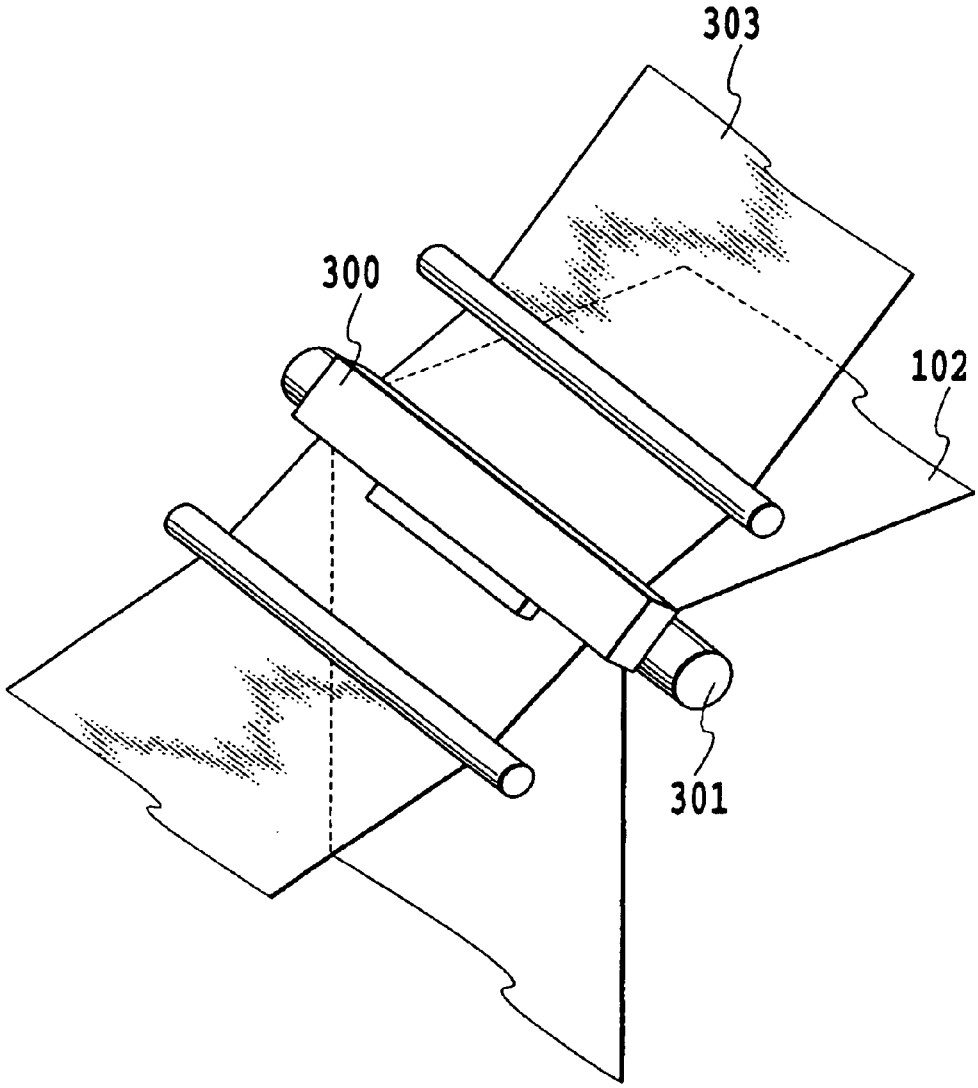
FIG. 7 is a perspective view conceptually showing a portion enclosed in a two-dot circle in FIG. 5.

In FIG. 6 and FIG. 7, denoted by reference numeral 300 is a thermal head disposed opposite a platen roller 301. The thermal head 300 has an array of heaters corresponding to pixels of an image, as found in a common full-line type print head using a thermal transfer printing method. Here, the thermal head 300 has a width equal to a maximum width of the print medium 102, as shown in FIG. 7.

A transparent transfer film rolled up into a supply roller 302A is fed between the thermal head 300 and the platen roller 301 and wound up on a takeup roller 302B. The transfer film is transported with a predetermined uniform tension in a thrust direction.

In the post-processing unit 110 of the above construction, when a print medium 102 is supplied, those transfer heaters in the thermal head 300 that correspond to the width of the print medium 102 are applied predetermined drive signals to generate heat. This heat fuses a transparent resin layer or wax layer or both, formed on a base material of the transfer film 303, so that the transparent resin layer is transferred onto a front surface layer on the printing side of the print medium 102. As a result, the surface of this print medium is formed with a transparent protective layer. At this time, the base material (e.g., polyethylene terephthalate (PET)) of the transfer film 303 that was carrying the protective layer is moved in a direction different from that of the print medium for winding up on the takeup roller 302B. This takeup roller 302B is disposed of after use.

The transfer film 303 may be of a general purpose type that has been in wide use, and is not limited to any particular type. The transfer film, however, should preferably be one made of a transparent, colorless material (not containing coloring substances). Further, if an ultraviolet ray absorbing material is mixed in the transfer film, an improved weatherability of the print medium can be expected.

After being formed with the protective layer on its surface by thermal transfer, the print medium 102 is discharged by a discharge roller 304 onto a discharge tray 115 (see FIG. 5).

(Fourth Embodiment)

Next, a fourth embodiment of the construction characteristic of the present invention will be described. The fourth embodiment has the second basic construction.

The fourth embodiment is characterized in that, in the image forming process by the print heads 200 of the painting unit 105, the operation of the thermal head 300 is optimized for each predetermined unit area by taking into account an ink volume applied to the print medium 102, a time which elapses from the ink application to the start of the post-processing (lamination), and a thermal head temperature in the post-processing unit 110.

Figure 16:
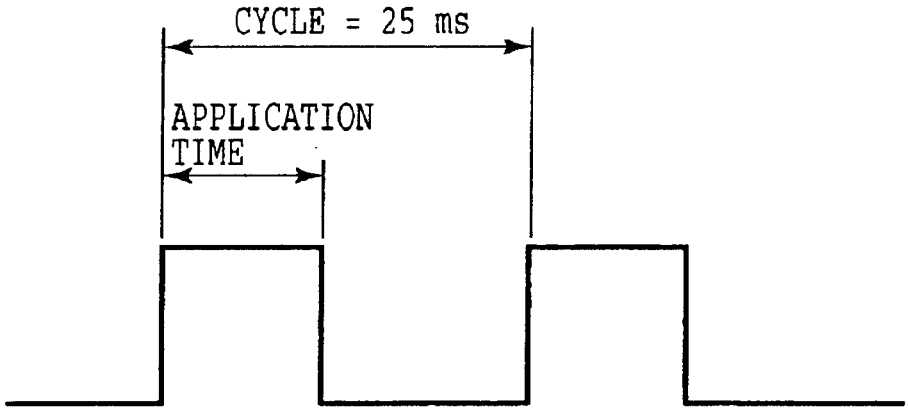
FIG. 16 illustrates an example of a drive signal applied to a thermal head in this embodiment of the invention.

In the fourth embodiment, the drive signal applied to the thermal head 300 is, for example, a single square wave pulse applied every 25 ms, as shown in FIG. 16. The drive pulse is not limited to this waveform, for example, a divided square wave (it is a double pulse if it is divided in two) may be used as an appropriate pulse. Further, from a Pop No. vs. drive voltage application time table of FIG. 13, a drive voltage application time (pulse width) that matches a Pop No. (described later) is selected. The fourth embodiment uses, as one example, voltage application durations from 0.5 ms to 1.2 ms corresponding to Pop Nos. 1 to 8. Thus, specifying the Pop No. determines the drive voltage application time (pulse width).

A procedure for determining the Pop No. will be explained by referring to a flow chart of FIG. 10. First, a calculation means (not shown) calculates ink volumes applied to the print medium 102 in the printing unit 105 and classifies the ink volume for each unit area into one of three ranks A, B, C, with A representing the smallest volume and C the largest (step S1).

Figure 14:
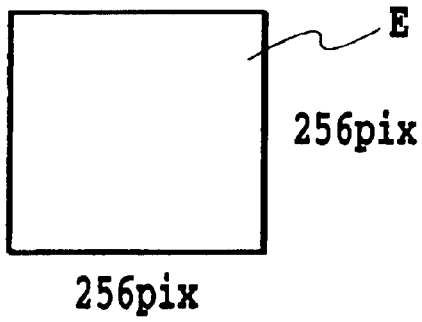
FIG. 14 is a diagram showing a unit area in the fourth embodiment of the invention.

The unit area refers to an area equal to an integer times the pixel that can be controlled by the thermal head 300. For each unit area the driving condition of the thermal head 300 is set or changed to drive the thermal head 300 optimally. In the fourth embodiment, for example, an area of 256×256 pixels as shown in FIG. 14 is taken as a unit area E.

The applied ink volume is determined based on image data that was printed by the print heads 200 in the printing unit 105. That is, the applied ink volume is calculated from the ink volumes ejected from the print heads 200 of Bk (black), C (cyan), M (magenta) and Y (yellow) inks during the image forming process or from the number of drive pulses applied to the ejection heaters B provided in these print heads 200.

Figure 15:
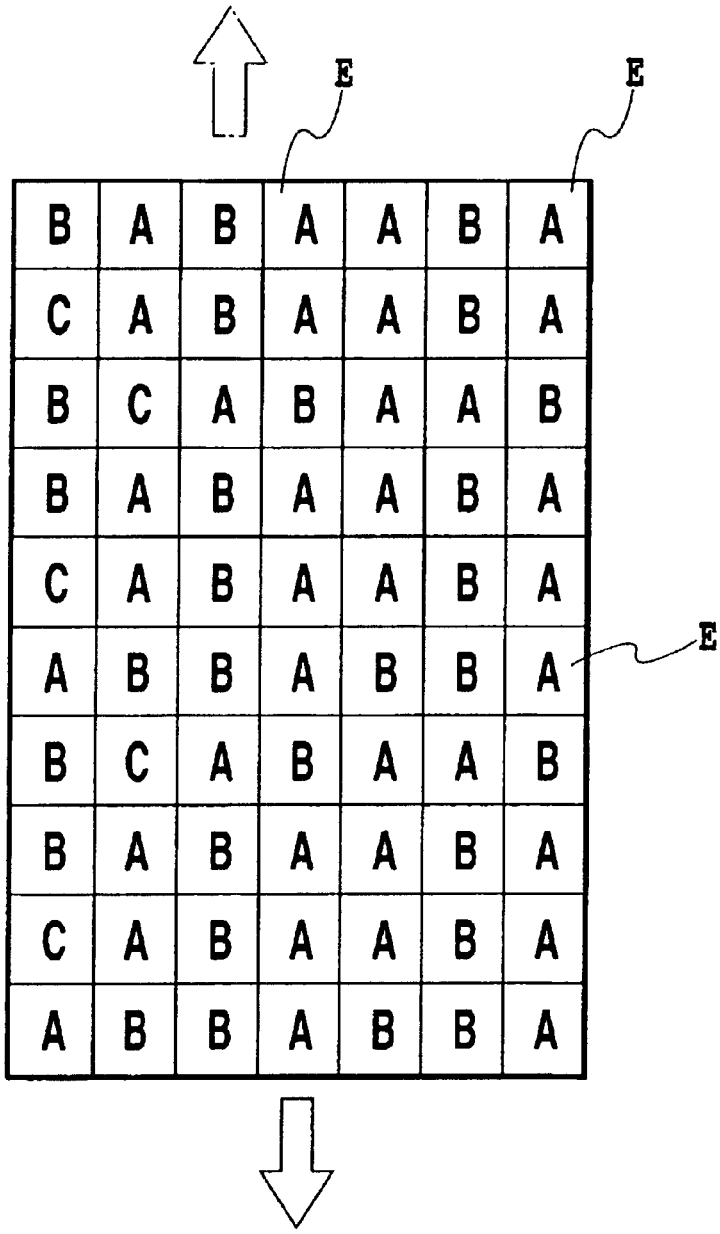
FIG. 15 is a map showing a result of classification into ranks of the amount of ink applied to each unit area of an image printed on a print medium.

FIG. 15 is a schematic diagram showing a result of ranking, for each unit area E of 256×256 pixels, the ink volume applied to an image printed on the print medium 102. A solid line arrow in the figure represents a direction in which the print medium is transported while being printed, and a chain line arrow represents a direction in which the print medium 102 is transported in a transport path ranging from the buffer area 111 to the post-processing unit 110. While this embodiment uses three ranks A, B, C for the applied ink volume, the number of ranks is not limited to three, but may be set to any desired number.

Figure 10:
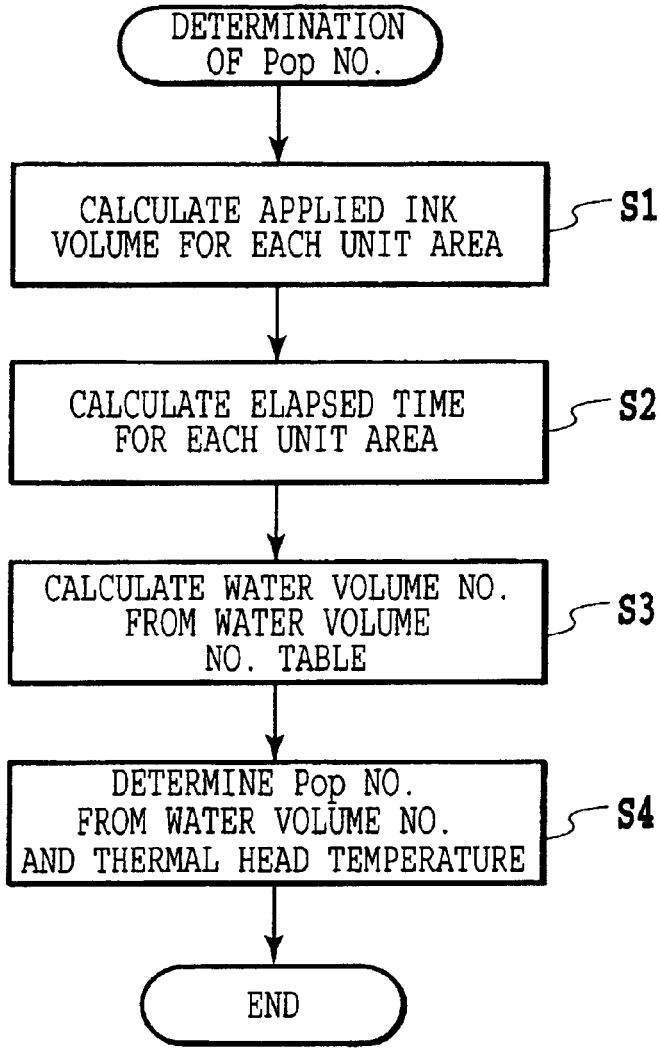
FIG. 10 is a flowchart showing a sequence of steps performed in a fourth embodiment of the invention.

Returning again to the flow chart of FIG. 10, after the applied ink volume is ranked for each unit area E in step S1 as described above, a time measuring means (not shown) measures a time it takes from when the printing unit 105 finishes the printing of each unit area E until the unit area begins to be laminated by the post-processing unit 110 (step S2).

Next, based on the time which elapses from each unit area being printed by the printing unit 105 to the unit area beginning to be laminated by the post-processing unit 110 and on the calculated ink volume rank for each unit area E, a water volume No. is determined for each unit area from a water volume No. table (see FIG. 11) (step S3). Considering the fact that the ink volume applied to the print medium evaporates over time, the water volume No. table provides ranked ink water volumes present in the individual unit areas E of the print medium immediately before the print medium is laminated. That is, the water volume No. begins with No. 1 and increases progressively, with a larger number representing the correspondingly larger water volume in the unit area E of the print medium.

After the water volume No. for each unit area E is determined, the Pop No. is then determined from a Pop No. table (see FIG. 12) based on the water volume No. and a temperature of the thermal head immediately before laminating the unit area E (step S4). Then, a drive voltage application time corresponding to the Pop No. found in the Pop No. vs. drive voltage application time table is read out and the drive voltage is applied to the thermal head 300 for the application time.

As described above, based on an ink volume applied to a print medium during the ink jet printing process and a time which elapses from the ink application to the start of a lamination, the printing apparatus of this embodiment calculates a water volume in the print medium that takes into account the water volume which may evaporate until the print medium is laminated. Further, using the calculated water volume and the temperature of the thermal head, the operation of the thermal head 300 is optimized, thus realizing a uniform lamination.

(Fifth Embodiment)

Next, a fifth embodiment of the construction characteristic of the present invention will be described. The fourth embodiment has the second basic construction.

The fifth embodiment is characterized in that the operation of the thermal head 300 is optimized according to an ink volume applied to the print medium 102 by the print heads 200 in the printing unit 105, a length of an image area in the print medium feeding direction (subscan direction), and a temperature of the thermal head 300.

In the fifth embodiment, the drive signal applied to the thermal head 300 is, for example, a single pulse applied every 25 ms, as shown in FIG. 16. The drive pulse is not limited to this waveform and a double pulse may be used as an appropriate pulse. Further, from a Pop No. vs. drive voltage application time table of FIG. 13, a drive voltage application time (pulse width) that matches a Pop No. (described later) is selected. The fifth embodiment uses, as one example, voltage application durations from 0.5 ms to 1.2 ms corresponding to Pop Nos. 1 to 8. Thus, specifying the Pop No. determines the drive voltage application time (pulse width).

Figure 22:
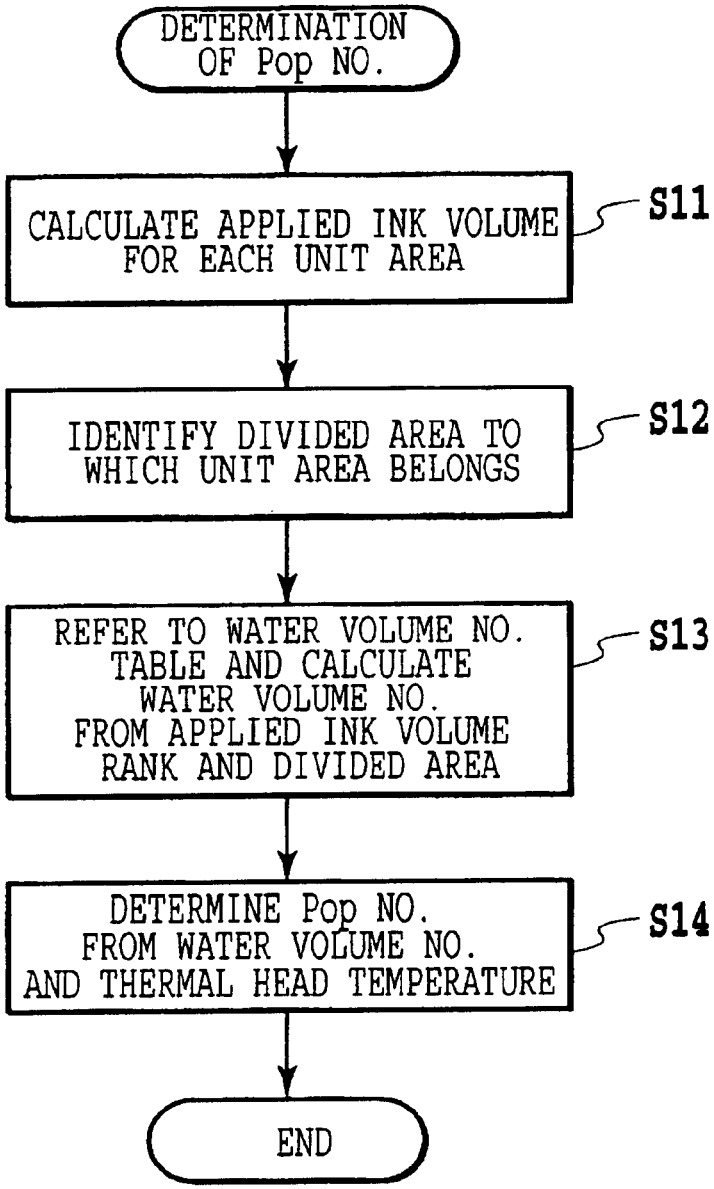
FIG. 22 is a flow chart showing a control operation in a fifth embodiment of the invention.

A procedure for determining the Pop No. will be explained by referring to a flow chart of FIG. 22. First, a calculation means (not shown) calculates ink volumes applied to the print medium in the printing unit 105 and classifies the ink volume for each unit area into one of three ranks A, B, C, with A representing the smallest volume and C the largest (step S11).

The method of ranking the applied ink volume is similar to that of the fourth embodiment.

FIG. 15 is an explanatory diagram showing a result of ranking, for each unit area of 256×256 pixels, the ink volume applied to the print medium 102 of a predetermined size (e.g., A4 size). A solid line arrow in the figure represents a direction in which the print medium is transported while being printed, and a chain line arrow represents a direction in which the print medium 102 is transported in a transport path ranging from the buffer area 111 to the post-processing unit 110.

Figure 17:
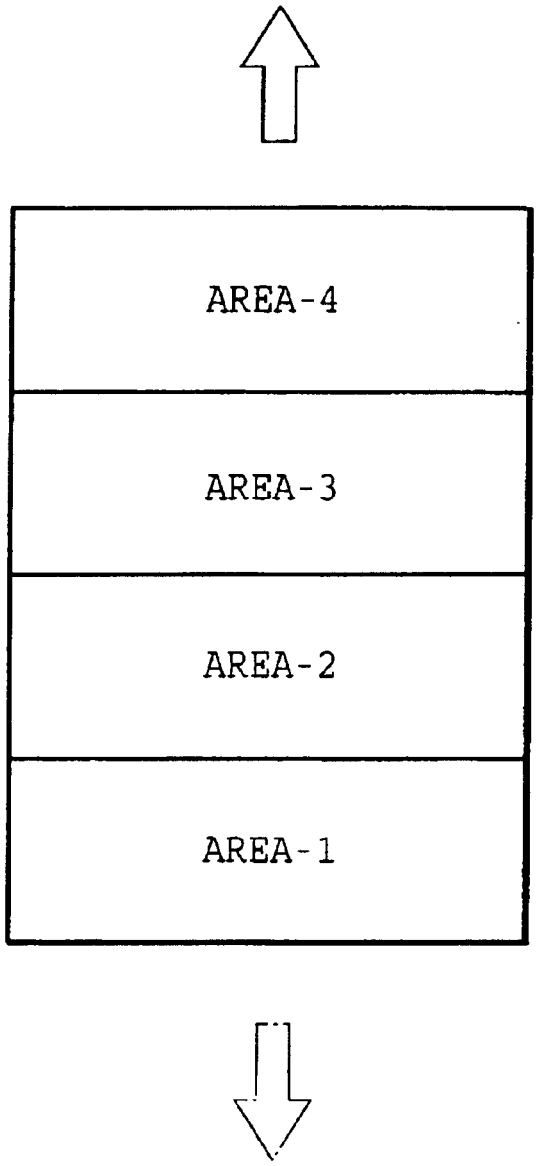
FIG. 17 is an explanatory diagram showing an A4-size image area divided into four areas, area-1 to area-4.

FIG. 17 is an explanatory diagram showing an A4-size image area divided into four areas, area-1 to area-4.

In this embodiment, a rough time it takes from the print medium 102 being applied with ink to its being post-processed is determined from an area of the image (step S12). That is, depending on which of the divided areas, from area-1 to area-4, the unit area E to be laminated belongs to, a rough time which has elapsed after the unit area E has been printed is calculated and a water volume that may have evaporated during that period of time is estimated.

If the image formation time taken by the ink jet print head and the lamination time taken by the thermal head are exactly the same, the time that elapses from the ink application to the lamination remains constant for all areas and thus the area decision process described above is not required. In this case the drive pulse need only be set by assuming a constant evaporation volume. However, if the image formation time required by the ink jet print head and the lamination time required by the thermal head differ, the time from the ink application to the lamination varies among different areas in the image, so that the water evaporation volume also varies. This means that an optimum drive pulse condition varies from one divided area to another. Further, in the fifth embodiment applying the second basic construction of FIG. 5, the printed medium that was cut by the cutter unit 109 is temporarily fed into the buffer area 111 and its front and rear ends are reversed before being sent to the post-processing unit. Hence, depending on the areas set in the print medium, the elapsed time from the image formation to the post-processing changes. To deal with this problem, the fifth embodiment therefore estimates a rough elapsed time according to which of the divided areas the unit area E to be laminated belongs to.

That is, in the fifth embodiment, the time which has elapsed from the ink application is estimated from the ink application volume in each unit area and from the divided area to which the unit area belongs, and these estimations are used to estimate the water evaporation volume, which is then taken into account in determining the drive pulse width.

Figure 18:
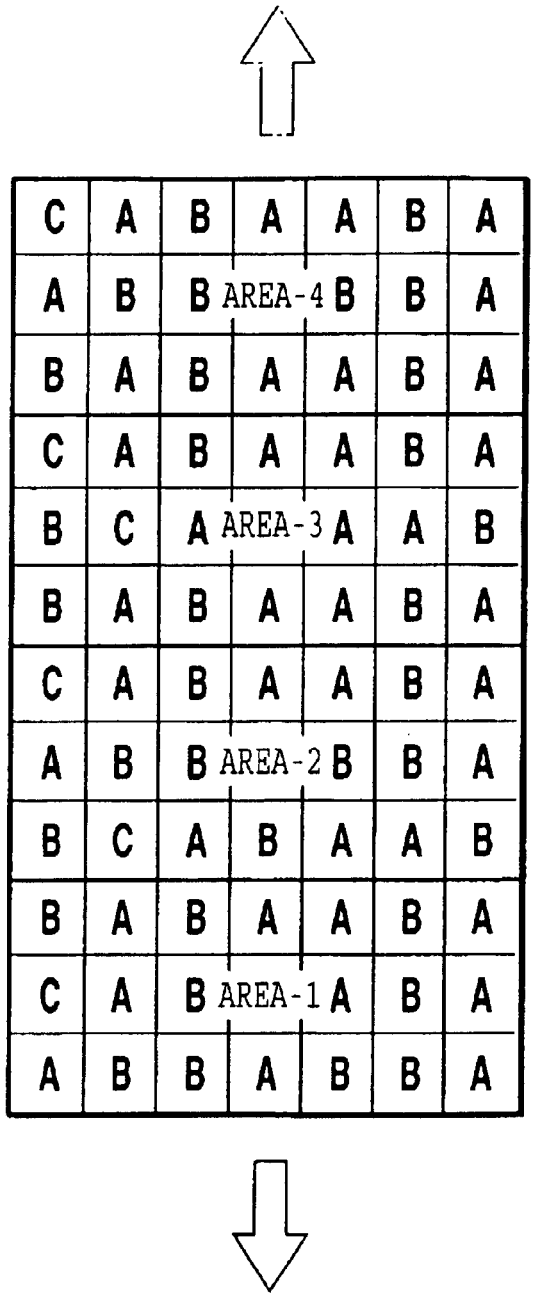
FIG. 18 shows the ink application volume map of FIG. 15 superimposed on the divided image areas of FIG. 17.

FIG. 18 is an explanatory diagram showing the ranked ink application volumes of FIG. 15 superimposed on the divided areas of FIG. 17.

Figure 19:
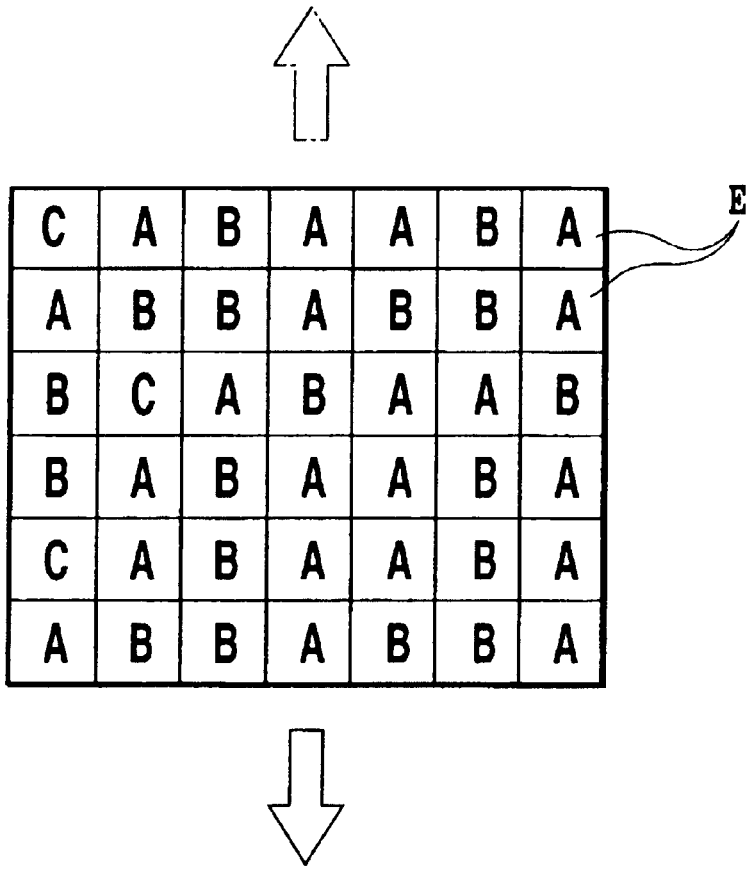
FIG. 19 is a map showing a result of classification into ranks of the amount of ink applied to each unit area of an image printed on a print medium, the unit areas each comprising 256×256 pixels.
Figure 20:
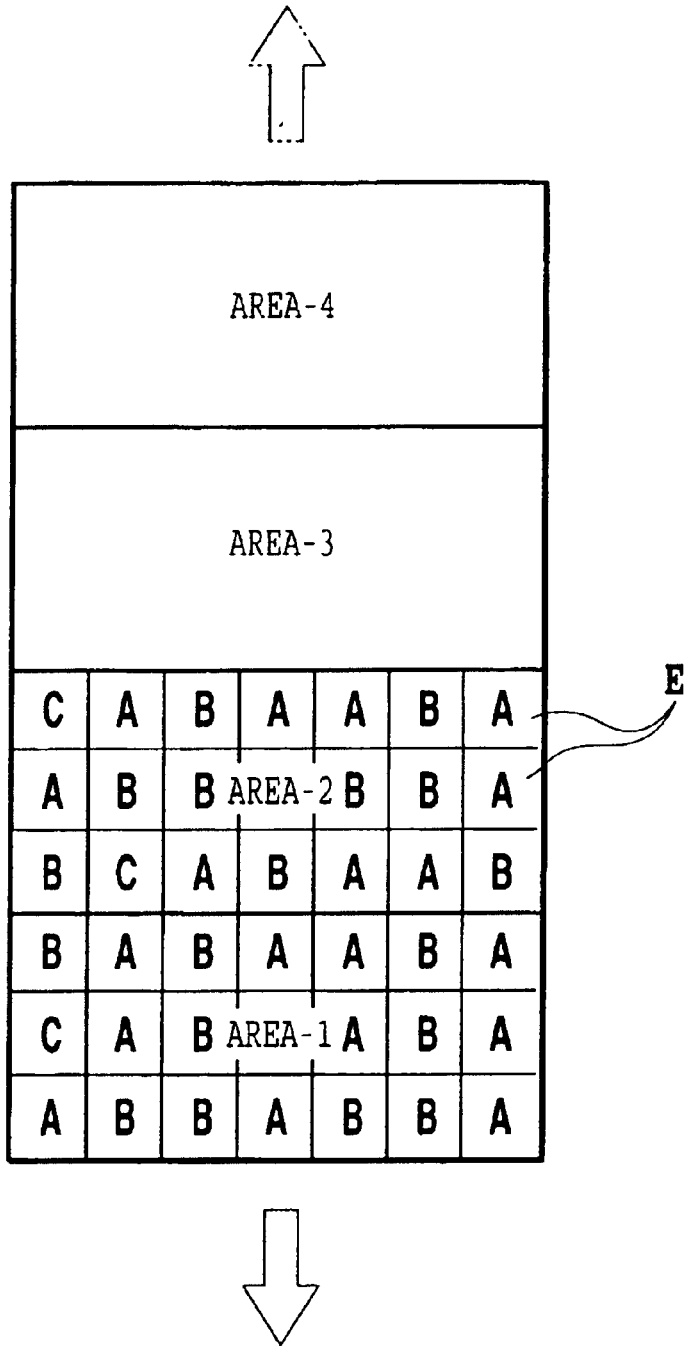
FIG. 20 shows the ink application volume map of FIG. 19 superimposed on the divided image areas of FIG. 17.

FIG. 19 shows ranked ink volumes applied to individual unit areas, each consisting of 256×256 pixels, on an image (A4 size) that is printed on a print medium as it is moved in a solid line arrow direction. FIG. 20 shows the ranked ink application volumes of FIG. 19 superimposed on the divided areas of FIG. 17. A solid line arrow in the figure represents a direction in which the print medium is transported while being printed, and a chain line arrow represents a direction in which the print medium 102 is transported in a transport path ranging from the buffer area 111 to the post-processing unit 110.

After the ink application volume is calculated for each unit area E and a decision is made as to which of the divided areas the unit area E belongs to (step S12), a water volume No. is determined for each unit area E from the water volume No. table (FIG. 21) in step S13. This water volume No. table is prepared considering the fact that the ink volume applied to the print medium evaporates over time, with the ink evaporation level considered to vary stepwise from one divided image area to another. The water volume No. table provides ranked water volumes present in the individual unit areas of the print medium immediately before the print medium is laminated. In this table, a greater water volume No. indicates a correspondingly greater water volume contained in a unit area belonging to the associated divided image area.

With the water volume No. determined for each unit area in this manner, step S14 determines a Pop No. from a Pop No. table (FIG. 12) based on the water volume No. and a thermal head temperature immediately before the unit area E is laminated. Referencing the Pop No. vs. drive voltage application time table of FIG. 13, the step S14 selects the drive voltage application time corresponding to the determined Pop No. Then, a drive pulse of a width matching the selected time is applied to the thermal head.

(Sixth Embodiment)

Next, a sixth embodiment of the present invention will be explained.

The sixth embodiment identifies the divided image areas of the fifth embodiment by counting the number of drive pulses for the thermal head.

That is, in the fifth embodiment one divided area is set to be three unit areas long in the print medium transport direction. In the sixth embodiment, on the other hand, the drive pulse for the thermal head 300 corresponding to each pixel is counted to realize the image area division similar to that of the fifth embodiment. That is, in terms of the number of pixels, each controllable by the thermal head 300, a count value of drive pulses corresponding to the 236 pixels×3 (=768 pixels) matches one divided area shown in FIG. 17.

Therefore, by counting how many pulses of the drive signal have been applied to the thermal head, it is possible to determine which of the divided areas the pixel of interest belongs to and the length of the printed image. Once the divided image area is identified, the water evaporation volume can be ranked for the same reason as described in the fifth embodiment.

FIG. 23 shows a water volume No. table used to calculate a water volume in this sixth embodiment.

Using this water volume No. table, it is possible to calculate the water volume No. from the ink application volume rank and the number of heat transfer drive pulses (number of pixels). In the same procedure as that of the fourth or fifth embodiment, a Pop No. is determined from the water volume No. and the temperature of the thermal head 300. Based on the Pop No. thus obtained, an appropriate drive voltage application duration (drive pulse width) is determined and the thermal head is driven for the voltage application duration.

As described above, in an ink jet printing apparatus with a post-processing unit which forms a protective layer on an image-formed surface of a print medium printed with an image in the printing unit, by laminating a protective sheet or film over the image-formed surface, the present invention can change, in localized areas, the thermal energy to be applied to the protective material according to the printing condition of the printing unit. Hence, even when an optimum heat transfer condition changes according to the applied ink volume, it is possible to correctly detect the heat transfer condition and apply an appropriate amount of heat to form a protective layer, thereby realizing appropriate post-processing.

Further, this invention provides a water volume estimation means that estimates a water content in the printed medium just before the printed medium is post-processed in the post-processing unit. According to the water content estimated by the water volume estimation means, the heat energy to be applied to the protective material is changed in localized areas This arrangement ensures that, even when the water content in the printed medium should change while it is transported from the printing unit to the post-processing unit, an appropriate protective layer can be formed reliably in response to that change With this invention, therefore, not only can water resistance and weather resistance of an output image be improved, but also a cost reduction and an increased processing speed of the printing apparatus can be realized.

The present invention has been described in detail with respect to preferred embodiments, and it will now be apparent from the foregoing to those skilled in the art that changes and modifications may be made without departing from the invention in its broader aspects, and it is the intention, therefore, that the appended claims to cover all such changes and modifications as fall within the true spirit of the invention.

What is claimed is:

1. An ink jet printing apparatus including a printing unit to form an image on a print medium according to an input image signal by using an ink jet print head having a plurality of nozzles for ejecting ink droplets and a protective layer forming unit to form a protective layer on the print medium printed with an image in the printing unit by applying heat energy to a protective material to laminate an image-formed surface of the print medium, the ink jet printing apparatus comprising:

control means to change, in localized areas, the heat energy to be applied to the protective material according to a printing condition of the printing unit, the printing condition being a substitute parameter that permits an estimation of an ink volume ejected from each nozzle of the print head.

2. An ink jet printing apparatus according to claim 1, wherein the protective layer forming unit uses a thermal head to apply the heat energy to the protective material in the form of a sheet.

3. An ink jet printing apparatus according to claim 2, wherein the thermal head can change a range of heat applied to the protective material placed over the print medium.

4. An ink jet printing apparatus according to claim 2, wherein the thermal head has a plurality of heating elements capable of applying the heat energy to individual pixels independently of one another, the pixels being printed by the print head, and wherein each of the heating elements, when applied with an electric drive pulse, produces the thermal energy according to a waveform of the drive pulse.

5. An ink jet printing apparatus according to claim 2, wherein said control means controls a waveform of a drive pulse applied to each of a plurality of heating elements of the thermal head according to the printing condition of the printing unit.

6. An ink jet printing apparatus according to claim 5, wherein said control means comprises pulse width decision means to determine a width of a drive pulse applied to each of the heating elements according to the printing condition of the printing unit.

7. An ink jet printing apparatus according to claim 5, wherein said control means comprises pulse voltage decision means to determine a voltage of a drive pulse applied to each of the heating elements according to the printing condition of the printing unit.

8. An ink jet printing apparatus according to claim 1, wherein the printing condition of the printing unit is an ink volume applied to each of pixels making up an image formed on the print medium.

9. An ink jet printing apparatus according to claim 1, wherein the print head comprises in each nozzle an electrothermal transducer as an energy generation means for ink ejection.

10. An ink jet printing apparatus according to claim 1, further comprising a drying unit for drying the ink and water contained in the print medium, said drying unit being provided between the printing unit and the protective layer forming unit.

11. An ink jet printing apparatus according to claim 10, wherein the printing condition includes a temperature of the print head or the vicinity thereof.

12. An ink jet printing apparatus according to claim 10, wherein the printing condition includes a driving state of the drying unit.

13. An ink jet printing apparatus according to claim 12, wherein the printing condition of the printing unit includes an energy consumption of the drying unit.

14. An ink jet printing apparatus according to claim 10, wherein the printing condition includes a temperature of the drying unit.

15. An ink jet printing apparatus including a printing unit to form an image on a print medium by an ink jet print head according to image data and a protective layer forming unit to apply a protective layer to an image-formed surface of the print medium printed with an image in the printing unit by applying heat energy generated by a thermal head to a protective material, the ink jet printing apparatus comprising:

water volume estimation means to estimate a water volume contained in the print medium immediately before the protective layer is formed on the print medium in the protective layer forming unit; and control means to change, in localized areas, heat energy to be applied to the protective material according to the water volume estimated by said water volume estimation means.

16. An ink jet printing apparatus according to claim 15, wherein said water volume estimation means estimates the water volume contained in the print medium immediately before the print medium is post-processed, based on an ink volume applied to the print medium in the printing unit and a water volume evaporated after the print medium has passed through the printing unit until the print medium reaches the protective layer forming unit.

17. An ink jet printing apparatus according to claim 15, wherein said water volume estimation means estimates an evaporated water volume based on a time which elapses from when the print medium has been printed by the printing unit until the print medium reaches the protective layer forming unit, and then estimates, based on the estimated evaporated water volume and an applied ink volume, the water volume contained in the print medium immediately before the protective layer is formed on the print medium in the protective layer forming unit.

18. An ink jet printing apparatus according to claim 16, wherein said water volume estimation means estimates the evaporated water volume based on an image length in a print medium transport direction and a time which elapses from when the print medium has been printed by the printing unit until the print medium reaches the protective layer forming unit, and then estimates, based on the estimated evaporated water volume and an applied ink volume, the water volume contained in the print medium immediately before the print medium is post-processed.

19. An ink jet printing apparatus according to claim 15, wherein said water volume estimation means estimates an evaporated water volume based on the number of drive pulses for driving the thermal head and a time which elapses from when the print medium has been printed by the printing unit until the print medium reaches the protective layer forming unit, and then estimates, based on the estimated evaporated water volume and an applied ink volume, the water volume contained in the print medium immediately before the protective layer is formed on the print medium in the protective layer forming unit.

20. An ink jet printing apparatus according to claim 15, further comprising thermal head temperature detection means for detecting a temperature of the thermal head, wherein said control means changes, in localized areas, heat energy to be applied to the protective material according to the water volume in the print medium estimated by said water volume estimation means immediately before the protective layer is applied on the print medium in the protective layer forming unit and to the thermal head temperature detected by said thermal head temperature detection means.

21. An ink jet printing apparatus according to claim 15, wherein said control means changes, in localized areas, heat energy to be applied to the protective material by taking into account at least one of an ambient temperature and an ambient humidity in addition to the water volume in the print medium estimated by said water volume estimation means immediately before the protective layer is applied on the print medium in the protective layer forming unit and the thermal head temperature detected by said thermal head temperature detection means.

22. An ink jet printing apparatus according to claim 15, wherein said water volume estimation means estimates the water volume contained in the print medium for each area of a predetermined size.

23. An ink jet printing apparatus according to claim 15, wherein said water volume estimation means estimates, for each of a plurality of areas, the water volume contained in the print medium immediately before the protective layer is applied on the print medium in the protective layer forming unit, the plurality of areas being defined by dividing the print medium in two directions, a print medium transport direction and a direction crossing the print medium transport direction.

24. An ink jet printing apparatus according to claim 15, wherein said water volume estimation means estimates, for each of a plurality of areas, the water volume contained in the print medium immediately before the protective layer is applied on the print medium in the protective layer forming unit, the plurality of areas being defined by dividing the print medium in a print medium transport direction.

25. An ink jet printing apparatus including a printing unit to form an image on a print medium according to an input image signal by using an ink jet print head having a plurality of nozzles for ejecting ink droplets and a protective layer forming unit to form a protective layer on the print medium printed with an image in the printing unit by applying heat energy to a protective material to laminate an image-formed surface of the print medium, the ink jet printing apparatus comprising:

control means to change, in localized areas, the heat energy to be applied to the protective material according to a printing condition of the printing unit, the printing condition being an ink volume applied to each of pixels that make up an image formed on the print medium.

* * * * *

UNITED STATES PATENT AND TRADEMARK OFFICE

CERTIFICATE OF CORRECTION

PATENT NO. : 7,004,554 B2
APPLICATION NO. : 10/414227
DATED : February 28, 2006
INVENTOR(S) : Takekoshi et al.

It is certified that error appears in the above-identified patent and that said Letters Patent is hereby corrected as shown below:

COLUMN 3
Line 30, “with a” should read --with--.

COLUMN 4
Line 2, “tereprithalate” should read --terephthalate--; and
Line 34, “methods,” should read --method,--.

COLUMN 12
Line 23, “medium” should read --medium,--; and
Line 32, “undesirble.” should read --undesirable.--.

COLUMN 20
Line 8, “case” should read --case,--.

COLUMN 21
Line 56, “areas” should read --areas.--; and
Line 60, “change” should read --change.--.

Signed and Sealed this

Twenty-seventh Day of March, 2007

JON W. DUDAS
*Director of the United States Patent and Trademark Office*